US008471785B2

(12) United States Patent
Origuchi et al.

(10) Patent No.: US 8,471,785 B2
(45) Date of Patent: Jun. 25, 2013

(54) DRIVING DEVICE, DRIVING METHOD AND PLASMA DISPLAY APPARATUS

(75) Inventors: Takahiko Origuchi, Osaka (JP); Hidehiko Shoji, Osaka (JP); Yasuaki Mutou, Osaka (JP); Takateru Sawada, Osaka (JP)

(73) Assignee: Panasonic Corporation, Osaka (JP)

( * ) Notice: Subject to any disclaimer, the term of this patent is extended or adjusted under 35 U.S.C. 154(b) by 635 days.

(21) Appl. No.: 12/677,223

(22) PCT Filed: Aug. 20, 2008

(86) PCT No.: PCT/JP2008/002252

§ 371 (c)(1),
(2), (4) Date: Mar. 9, 2010

(87) PCT Pub. No.: WO2009/034681

PCT Pub. Date: Mar. 19, 2009

(65) Prior Publication Data

US 2010/0201678 A1 Aug. 12, 2010

(30) Foreign Application Priority Data

Sep. 11, 2007 (JP) ..... 2007-235296

(51) Int. Cl.
*G09G 3/28* (2006.01)

(52) U.S. Cl.
USPC ..... 345/63; 345/68; 345/214; 345/690

(58) Field of Classification Search
USPC ..... 345/60–72, 204, 208, 214, 215, 690
See application file for complete search history.

(56) References Cited

U.S. PATENT DOCUMENTS 6,150,767 A * 11/2000 Huang ..... 315/169.4
6,653,993 B1 11/2003 Nagao et al.

(Continued)

FOREIGN PATENT DOCUMENTS

EP 2063407 5/2009
EP 2063408 5/2009

(Continued)

OTHER PUBLICATIONS

Japan Official Action for corresponding Japanese Patent Application, mailed Feb. 7, 2012.

(Continued)

*Primary Examiner* — Lun-Yi Lao
*Assistant Examiner* — Tom Sheng
(74) *Attorney, Agent, or Firm* — Greenblum & Bernstein, P.L.C.

(57) ABSTRACT

A first ramp waveform (RW1) rising from a first potential (Vscn) to a second potential (Vscn+Vset) is applied to a plurality of scan electrodes (SCi) in a first period (t5 to t6), and a driving waveform dropping from a third potential (Ve1) to a fourth potential (0V) is applied to a plurality of sustain electrodes (SUi) before the first period (t5 to t6), and the plurality of sustain electrodes are held at the fourth potential (0V) in the first period (t5 to t6). At this time, a second ramp waveform (RW10) rising from a fifth potential (0V) to a sixth potential (Vd) according to change of a potential of the first ramp waveform (RW1) is applied to a plurality of data electrodes (Dj) in a second period (t5 to t5*a*) that starts at a starting time point (t5) of the first period (t5 to t6) and is shorter than the first period (t5 to t6), thereby preventing generation of strong discharges between the plurality of data electrodes (Dj) and the plurality of scan electrodes (SCi).

8 Claims, 16 Drawing Sheets

U.S. PATENT DOCUMENTS

| | | | | |
|---|---|---|---|---|
| 6,900,598 | B2 * | 5/2005 | Hibino et al. | 315/169.4 |
| 7,068,245 | B2 * | 6/2006 | Nagao et al. | 345/60 |
| 7,511,707 | B2 * | 3/2009 | Ito et al. | 345/204 |
| 2003/0174102 | A1 * | 9/2003 | Jeong | 345/60 |
| 2004/0021622 | A1 | 2/2004 | Nagao et al. | |
| 2004/0227701 | A1 * | 11/2004 | Chung et al. | 345/60 |
| 2004/0239588 | A1 | 12/2004 | Nagao et al. | |
| 2005/0264479 | A1 | 12/2005 | Ito et al. | |
| 2006/0001600 | A1 | 1/2006 | Ito | |
| 2006/0139243 | A1 * | 6/2006 | Han et al. | 345/60 |
| 2006/0214885 | A1 * | 9/2006 | Jung et al. | 345/63 |
| 2006/0284796 | A1 * | 12/2006 | Kigo et al. | 345/60 |
| 2007/0075934 | A1 * | 4/2007 | Hirose et al. | 345/67 |
| 2007/0216608 | A1 * | 9/2007 | Choi | 345/67 |
| 2007/0262922 | A1 * | 11/2007 | Kim et al. | 345/60 |
| 2007/0279331 | A1 | 12/2007 | Nagao et al. | |
| 2008/0048940 | A1 | 2/2008 | Nagao et al. | |
| 2008/0055203 | A1 | 3/2008 | Nagao et al. | |
| 2008/0062080 | A1 | 3/2008 | Nagao et al. | |
| 2008/0062081 | A1 | 3/2008 | Nagao et al. | |
| 2008/0062082 | A1 | 3/2008 | Nagao et al. | |
| 2008/0062085 | A1 | 3/2008 | Nagao et al. | |
| 2008/0068302 | A1 | 3/2008 | Nagao et al. | |
| 2008/0068303 | A1 | 3/2008 | Nagao et al. | |
| 2008/0079667 | A1 | 4/2008 | Nagao et al. | |
| 2008/0150838 | A1 | 6/2008 | Nagao et al. | |
| 2008/0165170 | A1 | 7/2008 | Nagao et al. | |
| 2009/0079720 | A1 | 3/2009 | Murata et al. | |
| 2009/0122041 | A1 * | 5/2009 | Shoji et al. | 345/208 |
| 2010/0066718 | A1 | 3/2010 | Kuranuki et al. | |
| 2010/0103161 | A1 | 4/2010 | Origuchi et al. | |
| 2010/0128023 | A1 | 5/2010 | Shoji et al. | |

FOREIGN PATENT DOCUMENTS

| | | |
|---|---|---|
| JP | 2003-015599 | 1/2003 |
| JP | 2003-271092 | 9/2003 |
| JP | 2005-338784 | 12/2005 |
| JP | 2006-018298 | 1/2006 |
| JP | 2007-249204 | 9/2007 |
| WO | 02/101707 | 12/2002 |
| WO | 2007/032403 | 3/2007 |
| WO | 2007/129641 | 11/2007 |
| WO | 2008/066084 | 6/2008 |
| WO | 2008/069209 | 6/2008 |
| WO | 2009/040983 | 4/2009 |

OTHER PUBLICATIONS

U.S. Appl. No. 12/669,826 to Origuchi et al., filed Jan. 20, 2010.
U.S. Appl. No. 12/066,552 to Shoji et al., filed Mar. 12, 2010.
U.S. Appl. No. 12/066,552 to Shoji et al., filed Mar. 12, 2008.

* cited by examiner

DRIVING DEVICE, DRIVING METHOD AND PLASMA DISPLAY APPARATUS

TECHNICAL FIELD

The present invention relates to a driving device and a driving method for selectively subjecting a plurality of discharge cells to discharge to cause images to be displayed on a plasma display panel, and a plasma display apparatus.

BACKGROUND ART

Configuration of Plasma Display Panel

An AC surface discharge type panel that is typical as a plasma display panel (hereinafter abbreviated as a "panel") includes a number of discharge cells between a front plate and a back plate arranged to face each other.

The front plate is constituted by a front glass substrate, a plurality of display electrodes, a dielectric layer and a protective layer. Each display electrode is composed of a pair of scan electrode and sustain electrode. The plurality of display electrodes are formed in parallel with one another on the front glass substrate, and the dielectric layer and the protective layer are formed to cover the display electrodes.

The back plate is constituted by a back glass substrate, a plurality of data electrodes, a dielectric layer, a plurality of barrier ribs and phosphor layers. The plurality of data electrodes are formed in parallel with one another on the back glass substrate, and the dielectric layer is formed so as to cover the data electrodes. The plurality of barrier ribs are formed in parallel with the data electrodes, respectively, on the dielectric layer, and the phosphor layers of R (red), G (green) and B (blue) are formed on a surface of the dielectric layer and side surfaces of the barrier ribs.

The front plate and the back plate are arranged to face each other such that the display electrodes intersect with the data electrodes in three dimensions, and then sealed. An inside discharge space is filled with a discharge gas. The discharge cells are formed at respective portions at which the display electrodes and the data electrodes face one another.

In the panel having such a configuration, a gas discharge generates ultraviolet rays, which cause phosphors of R, G and B to be excited and to emit light in each of the discharge cells. Accordingly, color display is performed.

A sub-field method is employed as a method of driving the panel. In the sub-field method, one field period is divided into a plurality of sub-fields, and the discharge cells are caused to emit light or not in the respective sub-fields, so that gray scale display is performed. Each of the sub-fields has a setup period, a write period and a sustain period.

(Driving Method 1 of Conventional Panel)

In the setup period, a weak discharge (setup discharge) is performed to form wall charges required for a subsequent write operation in each discharge cell. In addition, the setup period has a function of generating priming for reducing a discharge time lag to stably generate a write discharge. Here, the priming means an excited particle that serves as an initiating agent for the discharge.

In the write period, scan pulses are applied to the scan electrodes in sequence while write pulses corresponding to image signals to be displayed are applied to the data electrodes. This selectively generates the write discharges between the scan electrodes and the data electrodes, causing the wall charges to be selectively formed.

In the subsequent sustain period, sustain pulses are applied between the scan electrodes and the sustain electrodes a predetermined number of times corresponding to luminances to be displayed. Accordingly, discharges are selectively induced in the discharge cells in which the wall charges have been formed by the write discharges, causing the discharge cells to emit light.

Here, in the foregoing setup period, respective voltages applied to the scan electrodes, the sustain electrodes and the data electrodes are adjusted in order to generate the weak discharges in the discharge cells.

Specifically, a ramp waveform gradually rising is applied to the scan electrodes while the potential of the data electrodes is held at 0 V (the ground potential) in the first half of the setup period (hereinafter referred to as a rise period). This generates the weak discharges between the scan electrodes and the data electrodes and between the sustain electrodes and the data electrodes in the rise period.

Moreover, a ramp waveform gradually dropping is applied to the scan electrodes while the potential of the data electrodes is held at the ground potential in the second half of the setup period (hereinafter referred to as a drop period). This generates the weak discharges between the scan electrodes and the data electrodes and between the sustain electrodes and the data electrodes in the drop period.

As described above, Patent Document 1, for example, discloses the method of driving the panel in which the ramp waveform or the voltage gradually rising or dropping is applied to the scan electrodes during the setup period. Thus, the wall charges stored on the scan electrodes and sustain electrodes are erased, and the wall charges required for the write operation are stored on each of the scan electrodes, the sustain electrodes and the data electrodes.

In practice, however, strong discharges may be generated between the scan electrodes and the data electrodes in the rise period. In this case, the strong discharges are generated between the scan electrodes and the sustain electrodes to generate a large amount of wall charges and a large amount of priming in the discharge cells, resulting in a higher possibility of the strong discharges to be generated also in the drop period.

The generation of the strong discharges in the setup period erases the wall charges stored on the scan electrodes, the sustain electrodes and the data electrodes. Thus, an appropriate amount of wall charges required for the write discharges cannot be formed on each electrode.

Therefore, Patent Document 2 discloses a method of driving the panel that prevents the generation of the strong discharges in the setup period.

(Driving Method 2 of Conventional Panel)

FIG. 15 shows examples of driving voltage waveforms (hereinafter referred to as driving waveforms) of the panel employing a method of driving the panel of Patent Document 2. FIG. 15 shows the driving waveforms applied to the scan electrodes, the sustain electrodes and the data electrodes, respectively, in the sustain period, the setup period and the write period.

As shown in FIG. 15, the data electrodes are held at a potential Vd that is higher than the ground potential in the rise period of the setup period in this example.

In this case, a voltage between the scan electrodes and the data electrodes is smaller than that when the data electrodes are held at the ground potential. Accordingly, a voltage between the scan electrodes and the sustain electrodes exceeds a discharge start voltage before the voltage between the scan electrodes and the data electrodes exceeds the discharge start voltage.

As described above, the weak discharges are induced between the scan electrodes and the sustain electrodes at an earlier timing, thereby generating the priming in the rise period. After that, the weak discharges are induced between the scan electrodes and the data electrodes, so that the wall charges required for the write operation are formed on each of the scan electrodes, the sustain electrodes and the data electrodes.

For example, the negative wall charges are stored on the scan electrodes and the positive wall charges are stored on the data electrodes when the write period shown in FIG. 15 is started. This results in stable write discharges in the write period.

[Patent Document 1] JP 2003-15599 A

[Patent Document 2] JP 2006-18298 A

DISCLOSURE OF THE INVENTION

Problems to be Solved by the Invention

In recent years, the number of discharge cells has been increased (an increase of pixels) while distances between adjacent discharge cells have been reduced with a larger screen and higher precision of a panel. As a result, crosstalk is liable to occur between the adjacent discharge cells, as will be described below.

As shown in FIG. 15, the potential of the sustain electrodes is raised after the elapse of a predetermined period of time (a phase difference TR) since the last rise of the potential of the scan electrodes to Vcl in a preceding sub-field. This induces erase discharges between the scan electrodes and the sustain electrodes, and the positive wall charges stored on the scan electrodes and the negative wall charges stored on the sustain electrodes are erased or reduced.

Next, the ramp waveform gradually rising is applied to the scan electrodes while the data electrodes are held at the potential Vd in the rise period of the setup period. Thus, the weak discharges are generated between the scan electrodes and the sustain electrodes, and the weak discharges are subsequently generated between the scan electrodes and the data electrodes. As a result, the negative wall charges are stored on the scan electrodes, and the positive wall charges are stored on the sustain electrodes. At this time, the positive wall charges are stored on the data electrodes.

In the drop period of the setup period, the ramp waveform gradually dropping is applied to the scan electrodes while the data electrodes are held at the ground potential. This generates the weak discharges between the scan electrodes and the data electrodes and between the sustain electrodes and the data electrodes. This results in the reduced negative wall charges stored on the scan electrodes and the reduced positive wall charges stored on the sustain electrodes. At this time, the positive wall charges are stored on the data electrodes.

In this manner, the negative wall charges are stored on the scan electrodes and the positive wall charges are stored on the data electrodes when the write period is started. In this state, negative-polarity write pulses are applied to the scan electrodes and positive-polarity write pulses are applied to the data electrodes in the write period. In this case, the foregoing wall charges increase the voltage between the scan electrodes and the data electrodes, thus stably generating the write discharges between the scan electrodes and the data electrodes.

At this time, since the positive wall charges are stored on the sustain electrodes, large write discharges are generated between the scan electrodes and the sustain electrodes. Accordingly, when the distances between the adjacent discharge cells are small, crosstalk is liable to occur between the adjacent discharge cells to cause erroneous discharges. Therefore, a method of driving the panel described below has been put into practical use in order to prevent such an occurrence of crosstalk.

(Driving Method 3 of Conventional Panel)

FIG. 16 shows examples of the driving waveforms of the panel for preventing the crosstalk from occurring between the adjacent discharge cells. Note that also in this example, the data electrodes are held at the voltage Vd that is higher than the ground potential in the rise period of the setup period.

In the driving waveforms of FIG. 16, the phase difference TR for the erase discharges is smaller than that in the driving waveforms of FIG. 15. The smaller phase difference TR results in the weaker erase discharges. Therefore, in the driving waveforms of FIG. 16, the erase discharges are weaker than those in the driving waveforms of FIG. 15 to cause more of positive wall charges to remain on the scan electrodes and more of negative wall charges to remain on the sustain electrodes before the setup period. This allows the write discharges in the write period to be weakened. As a result, it is considered that the crosstalk between the adjacent discharge cells can be prevented.

According to the experiments conducted by the inventor, however, it was found that the following phenomenon would occur in practice. As shown in FIG. 16, a ramp waveform gradually rising from a voltage Vm by a voltage Vset is applied to the scan electrodes, the sustain electrodes are held at the ground potential, and the data electrodes are held at the voltage Vd that is higher than the ground potential in the rise period of the setup period.

As described above, a large amount of positive wall charges is stored on the scan electrodes and a large amount of negative wall charges is stored on the sustain electrodes before the setup period. Therefore, when the voltage Vm is applied to the scan electrodes, the strong discharges are generated between the sustain electrodes and the data electrodes, thus generating the strong discharges between the scan electrodes and the sustain electrodes accordingly.

Such strong discharges are generated to erase the wall charges stored on the scan electrodes, the sustain electrodes and the data electrodes. Thus, the voltage between the scan electrodes and the sustain electrodes does not exceed the discharge start voltage even though the ramp waveform rising by the voltage Vset is applied to the scan electrodes, so that the weak discharges cannot be generated between the scan electrodes and the sustain electrodes.

This makes it difficult to adjust the wall charges on the scan electrodes, the sustain electrodes and the data electrodes to amounts required for the write discharges in the write period.

Therefore, it is considered that the ramp voltage applied to the scan electrodes is increased in order to generate the weak discharges after the generation of the foregoing strong discharges. However, this results in higher cost of a driving circuit.

An object of the present invention is to provide a driving device and a driving method capable of preventing the crosstalk from occurring between the adjacent discharge cells, and forming desired amounts of wall charges on the plurality of electrodes constituting the discharge cells, and a plasma display apparatus.

Means for Solving the Problems (1) According to an aspect of the present invention, a driving device that drives a plasma display panel including a plurality of discharge cells at intersections of a plurality of scan electrodes and a plurality of sustain electrodes with a plurality of data electrodes by a sub-field method in which one field period includes a plurality of sub-fields includes a scan electrode driving circuit that drives the plurality of scan electrodes, a sustain electrode driving circuit that drives the plurality of sustain electrodes, and a data electrode driving circuit that drives the plurality of data electrodes, wherein the scan electrode driving circuit applies a first ramp waveform rising from a first potential to a second potential to the plurality of scan electrodes in a first period within a setup period of at least one sub-field of the plurality of sub-fields, the sustain electrode driving circuit applies a driving waveform dropping from a third potential to a fourth potential to the plurality of sustain electrodes before the first period and holds the plurality of sustain electrodes at the fourth potential in the first period, and the data electrode driving circuit applies a second ramp waveform rising from a fifth potential to a sixth potential according to change of a potential of the first ramp waveform to the plurality of data electrodes in a second period that starts at a starting time point of the first period and is shorter than the first period.

In the driving device, the driving waveform that drops from the third potential to the fourth potential is applied to the plurality of sustain electrodes by the sustain electrode driving circuit before the first period within the setup period of the at least one sub-field of the plurality of sub-fields.

In the first period, the plurality of sustain electrodes are held at the fourth potential. In this state, the first ramp waveform that rises from the first potential to the second potential is applied to the plurality of scan electrodes by the scan electrode driving circuit in the first period.

In the second period that starts at the starting time point of the first period and is shorter than the first period, the second ramp waveform that rises from the fifth potential to the sixth potential according to the change of the potential of the first ramp waveform is applied to the plurality of data electrodes by the data electrode driving circuit.

This suppresses a larger potential difference between the plurality of scan electrodes and the plurality of data electrodes in the second period.

When a large amount of positive wall charges are stored on the plurality of scan electrodes and a large amount of negative wall charges are stored on the plurality of sustain electrodes before the second period, the potential difference between the plurality of scan electrodes and the plurality of sustain electrodes exceeds a discharge start voltage before the potential difference between the plurality of scan electrodes and the plurality of data electrodes exceeds the discharge start voltage, because the plurality of sustain electrodes are held at the fourth potential.

Thus, weak setup discharges are generated between the plurality of scan electrodes and the plurality of sustain electrodes. This decreases the negative wall charges stored on the plurality of sustain electrodes, thus preventing an occurrence of strong discharges between the plurality of sustain electrodes and the plurality of data electrodes.

Accordingly, strong discharges are prevented from occurring between the plurality of scan electrodes and the plurality of sustain electrodes under the influence of the strong discharges that could occur between the plurality of sustain electrodes and the plurality of data electrodes. This prevents the positive wall charges stored on the plurality of scan electrodes from being zero because of the occurrence of the strong discharges between the plurality of scan electrodes and the plurality of sustain electrodes in the second period.

This eliminates the necessity of setting a high potential of the first ramp waveform applied to the plurality of scan electrodes for generating the weak setup discharges between the plurality of scan electrodes and the plurality of sustain electrodes. As a result, rising cost of the scan electrode driving circuit is avoided.

After the second period, the potential difference between the plurality of scan electrodes and the plurality of data electrodes exceeds the discharge start voltage with rising the potential of the plurality of scan electrodes in the first period. This generates the weak setup discharges between the plurality of scan electrodes and the plurality of data electrodes. As a result, the amounts of the wall charges on the plurality of scan electrodes, the plurality of sustain electrodes and the plurality of data electrodes are adjusted to be suitable for a write operation.

In this manner, write discharges between the plurality of scan electrodes and the plurality of data electrodes and between the plurality of sustain electrodes and the plurality of scan electrodes are weakened in a write period. As a result, an occurrence of crosstalk between the adjacent discharge cells is prevented even when distances between the adjacent discharge cells are small.

(2) The data electrode driving circuit may bring the plurality of data electrodes into a floating state in the second period.

When the plurality of data electrodes are in the floating state, the potential of the plurality of data electrodes changes according to the potential change of the plurality of scan electrodes due to capacitive coupling. Accordingly, in the second period, the potential of the plurality of data electrodes changes according to the first ramp waveform applied to the plurality of scan electrodes. Thus, the second ramp waveform can be applied to the plurality of data electrodes by a simple circuit configuration. As a result, rising cost is avoided.

(3) The data electrode driving circuit may hold the plurality of data electrodes at the sixth potential after the second period in the first period.

In this case, the potential difference between the plurality of scan electrodes and the plurality of data electrodes is reliably increased with rising the potential of the plurality of scan electrodes to exceed the discharge start voltage after the second period. This generates the weak setup discharges between the plurality of scan electrodes and the plurality of data electrodes. As a result, the amounts of the wall charges on the plurality of scan electrodes, the plurality of sustain electrodes and the plurality of data electrodes are reliably adjusted to be suitable for the write operation.

(4) The first ramp waveform may be set based on the fourth potential such that discharges are generated between the plurality of scan electrodes and the plurality of sustain electrodes during change of the first ramp waveform from the first potential to the second potential, the fifth potential may be set based on the fourth potential such that discharges are not generated between the plurality of sustain electrodes and the plurality of data electrodes, and the sixth potential may be set based on the first ramp waveform such that discharges are generated between the plurality of scan electrodes and the plurality of data electrodes after the second period in the first period.

In this case, the first ramp waveform is set based on the fourth potential such that the discharges are generated between the plurality of scan electrodes and the plurality of sustain electrodes during the change of the first ramp waveform from the first potential to the second potential.

This generates the weak setup discharges between the plurality of scan electrodes and the plurality of sustain electrodes in the second period. Accordingly, the positive wall charges stored on the plurality of scan electrodes are decreased and the negative wall charges stored on the plurality of sustain electrodes are decreased.

Here, the fifth potential is set based on the fourth potential such that the discharges are not generated between the plurality of sustain electrodes and the plurality of data electrodes. Since the strong discharges are not generated between the plurality of sustain electrodes and the plurality of data electrodes, the positive wall charges stored on the plurality of scan electrodes are prevented from being zero because of the occurrence of the strong discharges between the plurality of scan electrodes and the plurality of sustain electrodes in the second period.

Thus, the wall charges on the plurality of scan electrodes and the wall charges on the plurality of sustain electrodes are adjusted by the weak setup discharges between the plurality of scan electrodes and the plurality of sustain electrodes to be held at an ending time point of the second period.

In addition, the sixth potential is set based on the first ramp waveform such that the discharges are generated between the plurality of scan electrodes and the plurality of data electrodes after the second period in the first period. This reliably generates the discharges between the plurality of scan electrodes and the plurality of data electrodes after the second period in the first period. Accordingly, the amount of the wall charges on the plurality of sustain electrodes are reliably adjusted to be suitable for the write operation.

As a result, the amounts of the wall charges on the plurality of scan electrodes, the plurality of sustain electrodes and the plurality of data electrodes are reliably adjusted to be suitable for the write operation in the first period.

(5) The scan electrode driving circuit may apply a driving waveform having a seventh potential to the plurality of scan electrodes at an end of a sustain period preceding the setup period of the at least one sub-field, and the sustain electrode driving circuit may apply a driving waveform that changes from the fourth potential to the third potential to the plurality of sustain electrodes during a period of application of the driving waveform having the seventh potential in order to decrease wall charges on the discharge cells in which sustain discharges have been performed.

In this case, weak erase discharges cause the large amount of wall charges to remain on the plurality of scan electrodes and the plurality of sustain electrodes at the end of the sustain period preceding the setup period of the at least one sub-field. Accordingly, the write discharges are weakened in the write period after the setup period to reliably prevent the crosstalk from occurring between the adjacent discharge cells.

(6) The scan electrode driving circuit may apply a third ramp waveform rising from a ground potential to an eighth potential to the plurality of scan electrodes at an end of a sustain period preceding the setup period of the at least one sub-field in order to decrease wall charges on the discharge cells in which sustain discharges have been performed, and the sustain electrode driving circuit may hold the plurality of sustain electrodes at the fourth potential during a period of application of the third ramp waveform.

In this case, the weak erase discharges cause the large amounts of wall charges to remain on the plurality of scan electrodes and the plurality of sustain electrodes since the third ramp waveform is applied to the plurality of scan electrodes at the end of the sustain period preceding the setup period of the at least one sub-field. Accordingly, the write discharges are weakened in the write period after the setup period to reliably prevent the crosstalk from occurring between the adjacent discharge cells.

(7) According to another aspect of the present invention, a driving method that drives a plasma display panel including a plurality of discharge cells at intersections of a plurality of scan electrodes and a plurality of sustain electrodes with a plurality of data electrodes by a sub-field method in which one field period includes a plurality of sub-fields includes the steps of applying a driving waveform dropping from a third potential to a fourth potential to the plurality of sustain electrodes before a first period within a setup period of at least one sub-field of the plurality of sub-fields, applying a first ramp waveform rising from a first potential to a second potential to the plurality of scan electrodes in the first period, holding the plurality of sustain electrodes at the fourth potential in the first period, applying a second ramp waveform rising from a fifth potential to a sixth potential according to change of a potential of the first ramp waveform to the plurality of data electrodes in a second period that starts at a starting time point of the first period and is shorter than the first period.

In the driving method, the driving waveform that drops from the third potential to the fourth potential is applied to the plurality of sustain electrodes before the first period within the setup period of the at least one sub-field of the plurality of sub-fields.

In the first period, the plurality of sustain electrodes are held at the fourth potential. In this state, the first ramp waveform that rises from the first potential to the second potential is applied to the plurality of scan electrodes in the first period.

In the second period that starts at the starting time point of the first period and is shorter than the first period, the second ramp waveform that rises from the fifth potential to the sixth potential according to the change of the potential of the first ramp waveform is applied to the plurality of data electrodes.

This suppresses a larger potential difference between the plurality of scan electrodes and the plurality of data electrodes in the second period.

When the large amount of positive wall charges are stored on the plurality of scan electrodes and the large amount of negative wall charges are stored on the plurality of sustain electrodes before the second period, the potential difference between the plurality of scan electrodes and the plurality of sustain electrodes exceeds the discharge start voltage before the potential difference between the plurality of scan electrodes and the plurality of data electrodes exceeds the discharge start voltage, because the plurality of sustain electrodes are held at the fourth potential.

Thus, weak setup discharges are generated between the plurality of scan electrodes and the plurality of sustain electrodes. This decreases the negative wall charges stored on the plurality of sustain electrodes, thus preventing an occurrence of strong discharges between the plurality of sustain electrodes and the plurality of data electrodes.

Accordingly, strong discharges are prevented from occurring between the plurality of scan electrodes and the plurality of sustain electrodes under the influence of the strong discharges that could occur between the plurality of sustain electrodes and the plurality of data electrodes. This prevents the positive wall charges stored on the plurality of scan electrodes from being zero because of the occurrence of the strong discharges between the plurality of scan electrodes and the plurality of sustain electrodes in the second period.

This eliminates the necessity of setting a high potential of the first ramp waveform applied to the plurality of scan electrodes for generating the weak setup discharges between the plurality of scan electrodes and the plurality of sustain electrodes. As a result, rising cost of the scan electrode driving circuit is avoided.

After the second period, the potential difference between the plurality of scan electrodes and the plurality of data electrodes exceeds the discharge start voltage with rising the potential of the plurality of scan electrodes in the first period. This generates the weak setup discharges between the plurality of scan electrodes and the plurality of data electrodes. As a result, the amounts of the wall charges on the plurality of scan electrodes, the plurality of sustain electrodes and the plurality of data electrodes are adjusted to be suitable for a write operation.

In this manner, write discharges between the plurality of scan electrodes and the plurality of data electrodes and between the plurality of sustain electrodes and the plurality of scan electrodes are weakened in a write period. As a result, an occurrence of crosstalk between the adjacent discharge cells is prevented even when distances between the adjacent discharge cells are small.

(8) According to still another aspect of the present invention, a plasma display apparatus includes a plasma display panel including a plurality of discharge cells at intersections of a plurality of scan electrodes and a plurality of sustain electrodes with a plurality of data electrodes, and a driving device that drives the plasma display panel by a sub-field method in which one field period includes a plurality of sub-fields, wherein the driving device includes a scan electrode driving circuit that drives the plurality of scan electrodes, a sustain electrode driving circuit that drives the plurality of sustain electrodes, and a data electrode driving circuit that drives the plurality of data electrodes, the scan electrode driving circuit applies a first ramp waveform rising from a first potential to a second potential to the plurality of scan electrodes in a first period within a setup period of at least one sub-field of the plurality of sub-fields, the sustain electrode driving circuit applies a driving waveform dropping from a third potential to a fourth potential to the plurality of sustain electrodes before the first period and holds the plurality of sustain electrodes at the fourth potential in the first period, and the data electrode driving circuit applies a second ramp waveform rising from a fifth potential to a sixth potential according to change of a potential of the first ramp waveform to the plurality of data electrodes in a second period that starts at a starting time point of the first period and is shorter than the first period.

In the plasma display apparatus, the driving device drives the plasma display panel including the plurality of discharge cells by the sub-field method in which one field period includes the plurality of sub-fields.

In the driving device, the driving waveform that drops from the third potential to the fourth potential is applied to the plurality of sustain electrodes by the sustain electrode driving circuit before the first period within the setup period of the at least one sub-field of the plurality of sub-fields.

In the first period, the plurality of sustain electrodes are held at the fourth potential. In this state, the first ramp waveform that rises from the first potential to the second potential is applied to the plurality of scan electrodes by the scan electrode driving circuit in the first period.

In the second period that starts at the starting time point of the first period and is shorter than the first period, the second ramp waveform that rises from the fifth potential to the sixth potential according to the change of the potential of the first ramp waveform is applied to the plurality of data electrodes by the data electrode driving circuit.

This suppresses a larger potential difference between the plurality of scan electrodes and the plurality of data electrodes in the second period.

When a large amount of positive wall charges are stored on the plurality of scan electrodes and a large amount of negative wall charges are stored on the plurality of sustain electrodes before the second period, the potential difference between the plurality of scan electrodes and the plurality of sustain electrodes exceeds a discharge start voltage before the potential difference between the plurality of scan electrodes and the plurality of data electrodes exceeds the discharge start voltage, because the plurality of sustain electrodes are held at the fourth potential.

Thus, weak setup discharges are generated between the plurality of scan electrodes and the plurality of sustain electrodes. This decreases the negative wall charges stored on the plurality of sustain electrodes, thus preventing an occurrence of strong discharges between the plurality of sustain electrodes and the plurality of data electrodes.

Accordingly, strong discharges are prevented from occurring between the plurality of scan electrodes and the plurality of sustain electrodes under the influence of the strong discharges that could occur between the plurality of sustain electrodes and the plurality of data electrodes. This prevents the positive wall charges stored on the plurality of scan electrodes from being zero because of the occurrence of the strong discharges between the plurality of scan electrodes and the plurality of sustain electrodes in the second period.

This eliminates the necessity of setting a high potential of the first ramp waveform applied to the plurality of scan electrodes for generating the weak setup discharges between the plurality of scan electrodes and the plurality of sustain electrodes. As a result, rising cost of the scan electrode driving circuit is avoided.

After the second period, the potential difference between the plurality of scan electrodes and the plurality of data electrodes exceeds the discharge start voltage with rising the potential of the plurality of scan electrodes in the first period. This generates the weak setup discharges between the plurality of scan electrodes and the plurality of data electrodes. As a result, the amounts of the wall charges on the plurality of scan electrodes, the plurality of sustain electrodes and the plurality of data electrodes are adjusted to be suitable for a write operation.

In this manner, write discharges between the plurality of scan electrodes and the plurality of data electrodes and between the plurality of sustain electrodes and the plurality of scan electrodes are weakened in a write period. As a result, an occurrence of crosstalk between the adjacent discharge cells is prevented even when distances between the adjacent discharge cells are small.

Effects of the Invention

According to the present invention, crosstalk is prevented from occurring between adjacent discharge cells, and desired amounts of wall charges can be formed on a plurality of electrodes constituting discharge cells.

BEST MODE FOR CARRYING OUT THE INVENTION

Figure 1:
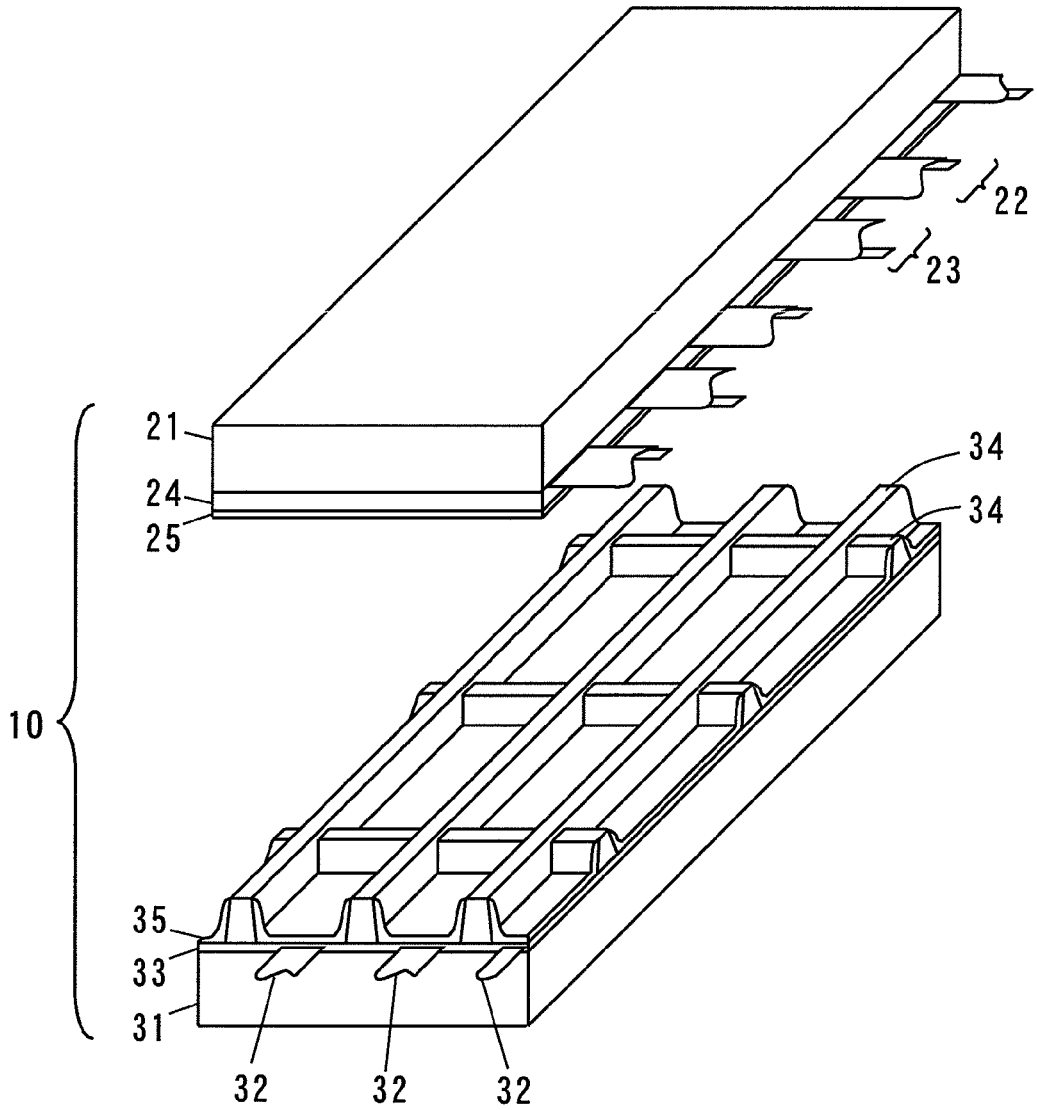
FIG. 1 is an exploded perspective view showing part of a plasma display panel in a plasma display apparatus according to one embodiment of the present invention.

The embodiments of the present invention will be described in detail referring to the drawings. The embodiments below describe a driving device, a driving method and a plasma display apparatus.

(1) Configuration of Panel

FIG. 1 is an exploded perspective view showing part of a plasma display panel in a plasma display apparatus according to one embodiment of the present invention.

The plasma display panel (hereinafter abbreviated as the panel) 10 includes a front substrate 21 and a back substrate 31 that are made of glasses and arranged to face each other. A discharge space is formed between the front substrate 21 and the back substrate 31. A plurality of pairs of scan electrodes 22 and sustain electrodes 23 are formed in parallel with one another on the front substrate 21. Each pair of scan electrode 22 and sustain electrode 23 constitutes a display electrode. A dielectric layer 24 is formed to cover the scan electrodes 22 and the sustain electrodes 23, and a protective layer 25 is formed on the dielectric layer 24.

A plurality of data electrodes 32 covered with an insulator layer 33 are provided on the back substrate 31, and barrier ribs 34 are provided in a shape of a number sign on the insulator layer 33. Phosphor layers 35 are provided on a surface of the insulator layer 33 and side surfaces of the barrier ribs 34. Then, the front substrate 21 and the back substrate 31 are arranged to face each other such that the plurality of pairs of scan electrodes 22 and sustain electrodes 23 vertically intersect with the plurality of data electrodes 32, and the discharge space is formed between the front substrate 21 and the back substrate 31. The discharge space is filled with a mixed gas of neon and xenon, for example, as a discharge gas. Note that the configuration of the panel is not limited to the configuration described in the foregoing. A configuration including the barrier ribs in a striped shape may be employed, for example.

The above-mentioned phosphor layers 35 include R (red), G (green) and B (blue) phosphor layers, any of which is provided in each discharge cell. One pixel on the panel 10 is constituted by three discharge cells including phosphors of R, G and B, respectively.

Figure 2:
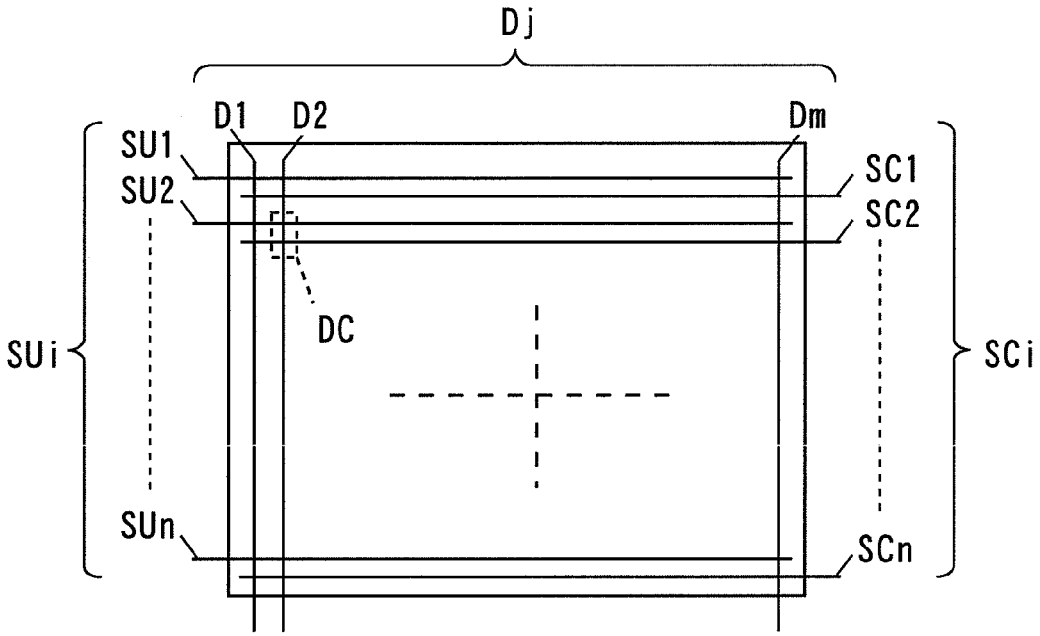
FIG. 2 is a diagram showing an arrangement of electrodes of the panel in the one embodiment of the present invention.

FIG. 2 is a diagram showing an arrangement of the electrodes of the panel in the one embodiment of the present invention. N scan electrodes SC1 to SCn (the scan electrodes 22 of FIG. 1) and n sustain electrodes SU1 to SUn (the sustain electrodes 23 of FIG. 1) are arranged along a row direction, and m data electrodes D1 to Dm (the data electrodes 32 of FIG. 1) are arranged along a column direction. Each of n and m is a natural number of not less than two. Then, a discharge cell DC is formed at an intersection of a pair of scan electrode SCi and sustain electrode SUi with one data electrode Dj. Accordingly, m×n discharge cells are formed in the discharge space. Note that i is an arbitrary integer of 1 to n, and j is an arbitrary integer of 1 to m.

(2) Configuration of the Plasma Display Apparatus

Figure 3:
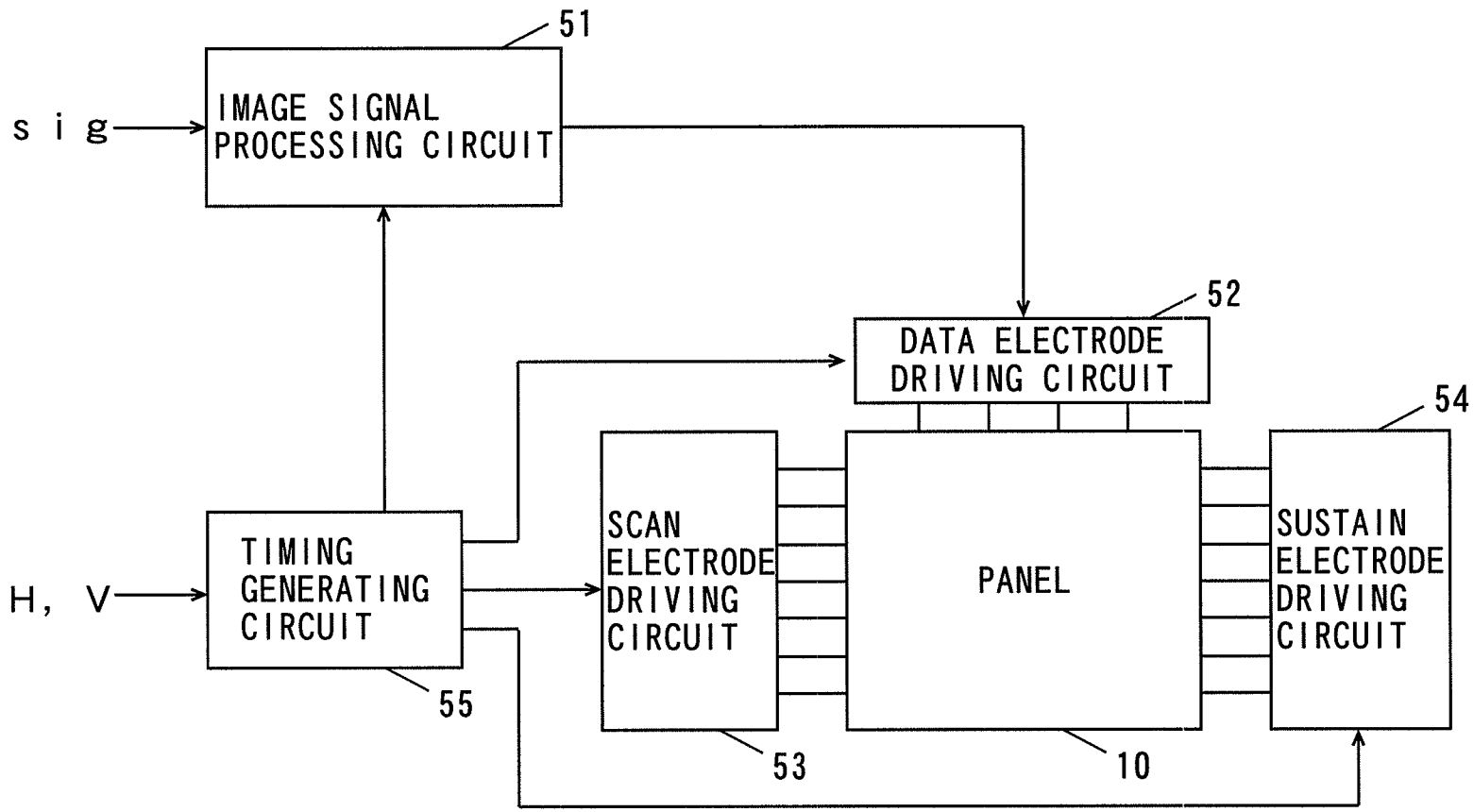
FIG. 3 is a block diagram of circuits in the plasma display apparatus according to the one embodiment of the present invention.

FIG. 3 is a block diagram of circuits in the plasma display apparatus according to the one embodiment of the present invention.

This plasma display apparatus includes the panel 10, an image signal processing circuit 51, a data electrode driving circuit 52, a scan electrode driving circuit 53, a sustain electrode driving circuit 54, a timing generating circuit 55 and a power supply circuit (not shown).

The image signal processing circuit 51 converts an image signal sig into image data corresponding to the number of pixels of the panel 10, divides the image data on each pixel into a plurality of bits corresponding to a plurality of sub-fields, and outputs them to the data electrode driving circuit 52.

The data electrode driving circuit 52 converts the image data for each sub-field into signals corresponding to the data electrodes D1 to Dm, respectively, and drives the data electrodes D1 to Dm based on the respective signals.

The timing generating circuit 55 generates timing signals based on a horizontal synchronizing signal H and a vertical synchronizing signal V, and supplies the timing signals to each of the driving circuit blocks (the image signal processing circuit 51, the data electrode driving circuit 52, the scan electrode driving circuit 53 and the sustain electrode driving circuit 54).

The scan electrode driving circuit 53 supplies driving waveforms to the scan electrodes SC1 to SCn based on the timing signals, and the sustain electrode driving circuit 54 supplies driving waveforms to the sustain electrodes SU1 to SUn based on the timing signals.

(3) Driving Method of the Panel

In the following description, a state where the data electrodes D1 to Dm are electrically separated from a power supply terminal, a ground terminal and a node (a floating state) is referred to as a high impedance state. In the high impedance state, the data electrodes D1 to Dm are capacitively coupled with the scan electrodes SC1 to SCn. Thus, the potential of the data electrodes D1 to Dm change according to change in the potential of the scan electrodes SC1 to SCn.

Figure 4:
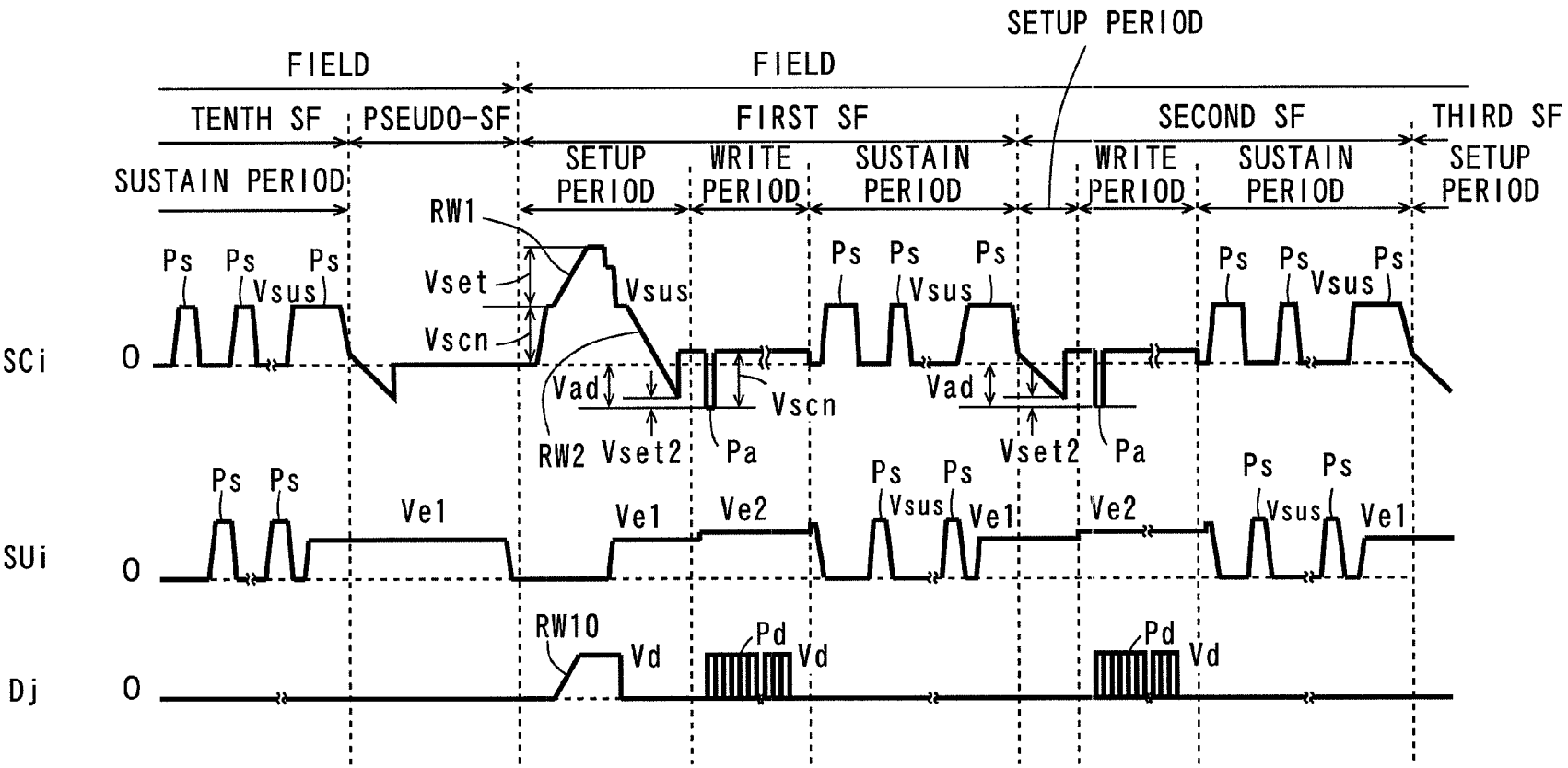
FIG. 4 is a diagram showing examples of driving waveforms applied to respective electrodes of the plasma display apparatus according to the one embodiment of the present invention.
Figure 5:
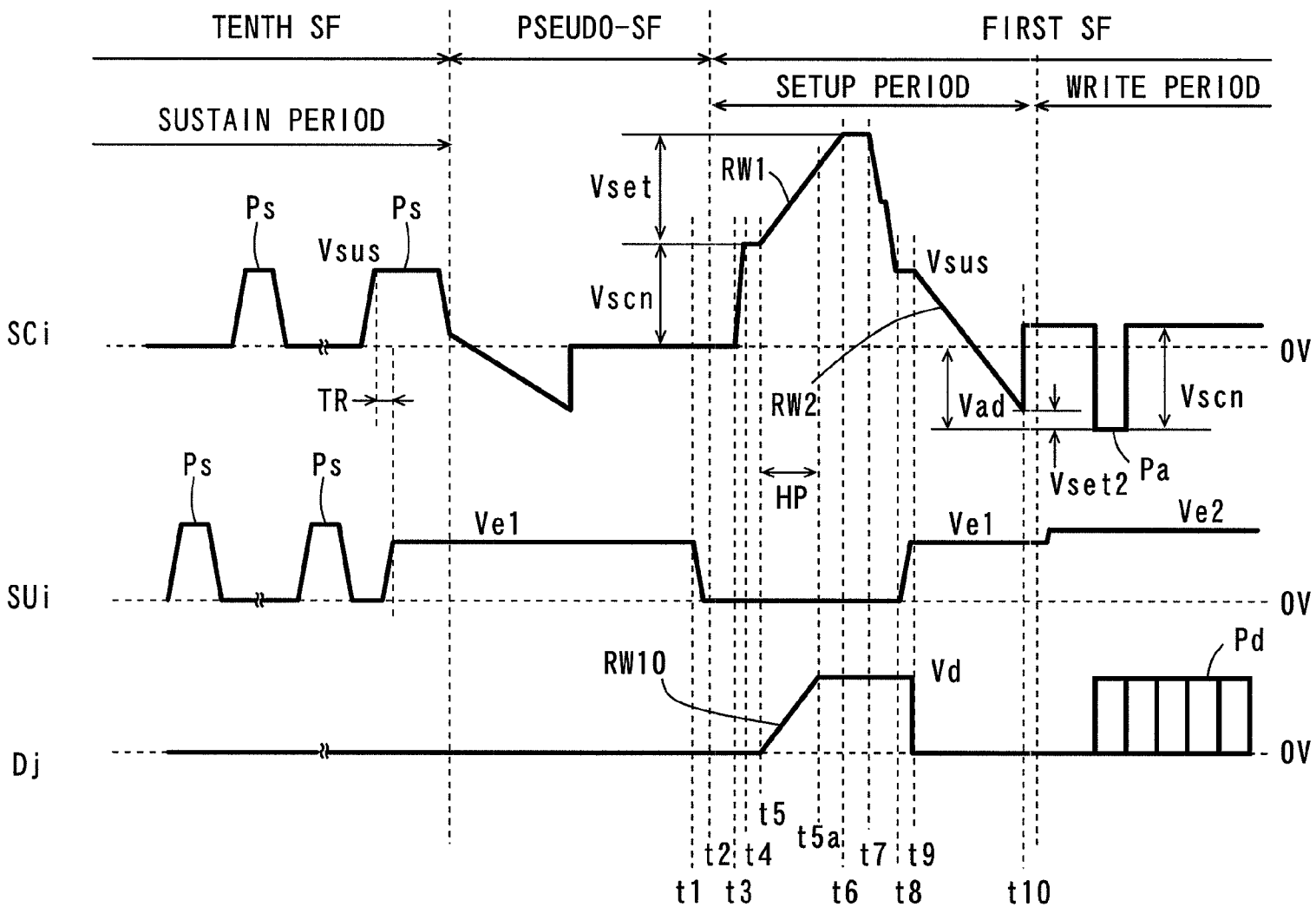
FIG. 5 is a partially enlarged view of the driving waveforms of FIG. 4.

FIG. 4 is a diagram showing examples of the driving waveforms applied to the respective electrodes in the plasma display apparatus according to the one embodiment of the present invention. FIG. 5 is a partially enlarged view of the driving waveforms of FIG. 4.

FIGS. 4 and 5 each show the driving waveforms of one scan electrode SCi, one sustain electrode SUi, and one data electrode Dj. Note that i is an arbitrary integer of 1 to n, and j is an arbitrary integer of 1 to m, as described above. Driving waveforms of other scan electrodes are the same as that of the scan electrode SCi except for timings of scan pulses. Driving waveforms of other sustain electrodes are the same as that of the sustain electrode SUi. Driving waveforms of other data electrodes are the same as that of the data electrode Dj except for states of write pulses.

In the present embodiment, each field is divided into a plurality of sub-fields each having a setup period, a write period and a sustain period. In the present embodiment, one field is divided into ten sub-fields (hereinafter abbreviated as a first SF, a second SF, . . . and a tenth SF) on a time base. In addition, a pseudo-sub-field (hereinafter abbreviated as a pseudo-SF) is provided in a period after the tenth SF of each field and before the next field.

FIG. 4 shows the driving waveforms in a period from a sustain period of the tenth SF of a field preceding one field to a setup period of the third SF of the one field. FIG. 5 shows the driving waveforms in a period from the sustain period of the tenth SF to a write period of the first SF of the next field of FIG. 4.

In the following description, a voltage caused by wall charges stored on the dielectric layer, the phosphor layers and so on covering the electrode is referred to as a wall voltage on the electrode. The first half of the setup period of the first SF, that is, a period from a time point t5 to a time point t6 of FIG. 5 is referred to as a rise period, and the second half of the setup period of the first SF, that is, a period from a time point t9 to a time point t10 of FIG. 5 is referred to as a drop period.

First, detailed description is made of a period from the end of the tenth SF of the preceding field to the write period of the first SF referring to FIG. 5.

As shown in FIG. 5, a sustain pulse Ps is applied to the scan electrode SCi at the end of the tenth SF of the preceding field. Thus, the potential of the sustain electrode SUi rises to a positive potential Ve1 after the elapse of a predetermined period of time (a phase difference TR of FIG. 5) since the rise of the potential of the scan electrode SCi to a positive potential Vsus.

Thus, an erase discharge is generated between the scan electrode SCi and the sustain electrode SUi to decrease the positive wall charges stored on the scan electrode SCi and the negative wall charges stored on the sustain electrode SUi. In the present embodiment, the phase difference TR is set small such that the erase discharge is weakened. In general, the phase difference TR for such an erase discharge is about 450 nsec. However, the phase difference TR is set to 150 nsec, for example, in this example.

In this manner, the phase difference TR is set small to weaken the erase discharge between the scan electrode SCi and the sustain electrode SUi. Accordingly, a large amount of positive wall charges remains on the scan electrode SCi, and a large amount of negative wall charges remains on the sustain electrode SUi. At this time, the positive wall charges are stored on the data electrode Dj.

The potential of the sustain electrode SUi is maintained at the positive potential Ve1, the potential of the data electrode Dj is maintained at 0 V (a ground potential), and a negative ramp waveform is applied to the scan electrode SCi in the first half of the pseudo-SF. This ramp waveform gradually drops from a positive potential that is slightly higher than the ground potential toward a negative potential.

Thus, weak discharges are generated between the scan electrode SCi and the sustain electrode SUi. As a result, the positive wall charges on the scan electrode SCi slightly increases, and the negative wall charges on the sustain electrode SUi slightly increases. The positive wall charges are stored on the data electrode Dj. In this manner, the wall charges on all the discharge cells DC are substantially uniformly adjusted.

In the second half of the pseudo-SF, the potential of the scan electrode SCi is maintained at the ground potential. In this manner, a large amount of positive wall charges is stored on the scan electrode SCi and a large amount of negative wall charges is stored on the sustain electrode SUi at the end of the pseudo-SF.

Then, the potential of the sustain electrode SUi drops from the positive potential Ve1 to the ground potential at a time point t1 immediately before the first SF of the next field.

The potential of the scan electrode SCi rises to a positive potential Vscn in a period from a time point t3 to a time point t4.

Here, the potentials of the sustain electrode SUi and the data electrode Dj are maintained at the ground potential in a period from a time point t2 to the time point t4. Therefore, the strong discharge is not generated between the sustain electrode SUi and the data electrode Dj. Accordingly, a state where the large amount of negative wall charges are stored on the sustain electrode SUi and the positive wall charges are stored on the data electrode Dj is maintained.

Then, a positive ramp waveform RW1 for a setup discharge is applied to the scan electrode SCi in the period from the time point t5 to the time point t6. The ramp waveform RW1 gradually rises from the positive potential Vscn toward a positive potential (Vscn+Vset).

Moreover, the data electrode Dj is brought into the high impedance state in a period from the time point t5 to a time point t5*a* within the rise period (hereinafter referred to as a high impedance period HP). Accordingly, the potential of the data electrode Dj changes according to the change in the potential of the scan electrodes SC1 to SCn, and the voltage between the scan electrode SCi and the data electrode Dj is held constant. In this example, the potential of the data electrode Dj gradually rises from the ground potential to a positive potential Vd (a ramp waveform RW10) during the high impedance period HP. Thus, the weak discharge is not generated between the scan electrode SCi and the data electrode Dj in the high impedance period HP.

The potential of the data electrode Dj is maintained at the positive potential Vd in a period from the time point t5*a* to the time point t6. This causes the voltage between the scan electrode SCi and the data electrode Dj to exceed the discharge start voltage to generate the weak discharge (setup discharge).

Meanwhile, the voltage between the scan electrode SCi and the sustain electrode SUi exceeds the discharge start voltage to generate the weak discharge (setup discharge) between the scan electrode SCi and the sustain electrode SUi in the period from the time point t5 to the time point t6.

In this manner, the weak discharges are generated between the scan electrode SCi and the sustain electrode SUi and between the scan electrode SCi and the data electrode Dj in the rise period. Thus, the negative wall charges are stored on the scan electrode SCi, and the positive wall charges are stored on the sustain electrode SUi at the time point t6. In addition, the positive wall charges are stored on the data electrode Dj.

Then, the potential of the scan electrode SCi drops from the positive potential (Vscn+Vset) to the positive potential Vsus in a period from a time point t7 to a time point t8.

The potential of the sustain electrode SUi rises to the positive voltage Ve1 in a period from the time point t8 to the time point t9, and the potential of the data electrode Dj drops to the ground potential at the time point t9.

Then, a negative ramp waveform RW2 is applied to the scan electrode SCi in the period from the time point t9 to the time point t10. The ramp waveform RW2 gradually drops from the positive potential Vsus toward a negative potential (−Vad+Vset2).

This causes the voltage between the scan electrode SCi and the sustain electrode SUi to exceed the discharge start voltage in the period from the time point t9 to the time point t10. As a result, the weak discharge (setup discharge) is generated between the scan electrode SCi and the sustain electrode SUi. Then, the weak discharge (setup discharge) is also generated between the scan electrode SCi and the data electrode Dj.

Accordingly, the negative wall charges stored on the scan electrode SCi are decreased and the positive wall charges stored on the sustain electrode SUi are decreased. In addition, the positive wall charges stored on the data electrode Dj are slightly decreased. As a result, a small amount of positive wall charges is stored on the scan electrode SCi, a small amount of negative wall charges is stored on the sustain electrode SUi, and the positive wall charges are stored on the data electrode Dj at the time point t10.

Then, the potential of the scan electrode SCi drops to the positive potential (Vscn−Vad) at the time point t10, and the setup period of the first SF is finished.

In this manner, the wall voltage on the scan electrode SCi, the wall voltage on the sustain electrode SUi and the wall voltage on the data electrode Dj are adjusted to respective values suitable for a write operation.

As described above, a setup operation for all cells in which setup discharges are generated in all the discharge cells DC is performed in the setup period of the first SF.

In the subsequent write period, first, the potential of the scan electrode SCi is maintained at the potential (Vscn−Vad) and the potential of the sustain electrode SUi rises to the positive potential Ve2.

Next, at a predetermined timing within the write period, a negative scan pulse Pa (=−Vad) is applied to the scan electrode SCi (i=1) on the first row while a positive write pulse Pd is applied to the data electrode Dk (k is any of 1 to m) of the discharge cell DC that should emit light on the first row.

Then, a voltage at an intersection of the data electrode Dk and the scan electrode SCi attains a value obtained by adding the wall voltage on the scan electrode SCi and the wall voltage on the data electrode Dk to an externally applied voltage (Pd−Pa), exceeding the discharge start voltage. This generates write discharges between the scan electrode SCi and the data electrode Dk and between the scan electrode SCi and the sustain electrode SUi.

As a result, in the discharge cell DC, the positive wall charges are stored on the scan electrode SCi, the negative wall charges are stored on the sustain electrode SUi, and the negative wall charges are stored on the data electrode Dk.

In this manner, the write operation in which the write discharge is generated in the discharge cell DC that should emit light on the first row is performed. Meanwhile, since a voltage at an intersection of a data electrode Dh (h≠k) to which the write pulse has not been applied and the scan electrode SCi does not exceed the discharge start voltage, the write discharge is not generated in the discharge cell DC at the intersection. The above-described write operation is sequentially performed in the discharge cells DC on the first row to the n-th row, and the write period is then finished.

As described in the foregoing, the small amount of negative wall charges is stored on the scan electrode SCi, the small amount of positive wall charges is stored on the sustain electrode SUi, and the positive wall charges are stored on the data electrode Dj at the start of the write period in this example. Therefore, the write discharge between the scan electrode SCi and the sustain electrode SUi is weakened. Accordingly, an occurrence of crosstalk between the adjacent discharge cells DC is prevented even when distances between the adjacent discharge cells are set small in the panel 10 of FIG. 1.

Returning to FIG. 4, in a subsequent sustain period, the potential of the sustain electrode SUi is returned to the ground potential, and the first sustain pulse Ps (=Vsus) is applied to the scan electrode SCi. At this time, the voltage between the scan electrode SCi and the sustain electrode SUi attains a value obtained by adding the wall voltage on the scan electrode SCi and the wall voltage on the sustain electrode SUi to the sustain pulse Ps (=Vsus), exceeding the discharge start voltage in the discharge cell DC in which the write discharge has been generated in the write period.

This induces a sustain discharge between the scan electrode SCi and the sustain electrode SUi, causing the discharge cell DC to emit light. As a result, the negative wall charges are stored on the scan electrode SCi, the positive wall charges are stored on the sustain electrode SUi, and the positive wall charges are stored on the data electrode Dj. In the discharge cell DC in which the write discharge has not been generated in the write period, the sustain discharge is not induced and the wall charges are held in a state at the end of the setup period.

Then, the potential of the scan electrode SCi is returned to the ground potential, and the sustain pulse Ps is applied to the sustain electrode SUi. Since the voltage between the sustain electrode SUi and the scan electrode SCi exceeds the discharge start voltage in the discharge cell DC in which the sustain discharge has been induced, the sustain discharge is again induced between the sustain electrode SUi and the scan electrode SCi, causing the negative wall charges to be stored on the sustain electrode SUi and the positive wall charges to be stored on the scan electrode SCi.

Similarly to this, a predetermined number of sustain pulses Ps are alternately applied to the scan electrode SCi and the sustain electrode SUi, so that the sustain discharges are continuously performed in the discharge cell DC in which the write discharge has been generated in the write period.

Before the sustain period is finished, the potential of the sustain electrode SUi attains the positive potential Ve1 after a predetermined period of time (the period of time corresponding to the phase difference TR of FIG. 5) has elapsed since the application of the sustain pulse Ps to the scan electrode SCi. This generates a weak erase discharge between the scan electrode SCi and the sustain electrode SUi, similarly to the case at the end of the tenth SF of the preceding field described referring to FIG. 5.

In a setup period of the second SF, a ramp waveform gradually dropping from the positive potential toward the negative potential (−Vad) is applied to the scan electrode SCi while the sustain electrode SUi is held at the positive potential Ve1 and the data electrode Dj is held at the ground potential. Then, the weak discharge (the setup discharge) is generated in the discharge cell DC in which the sustain discharge has been induced in the sustain period of the preceding sub-field.

In this manner, the wall voltage on the scan electrode SC1 and the wall voltage on the sustain electrode SUi are weakened, and the wall voltage on the data electrode Dj is adjusted to a value suitable for the write operation. As described above, a selective setup operation in which the setup discharge is selectively generated in the discharge cell DC in which the sustain discharge has been generated in the immediately preceding sub-field is performed in the setup period of the second SF.

In a write period of the second SF, the write operation is sequentially performed in the discharge cells on the first row to the n-th row similarly to the write period of the first SF, and the write period is then finished. Since an operation in the subsequent sustain period is the same as that in the sustain period of the first SF except for the number of the sustain pulses, explanation is omitted.

In setup periods of the subsequent third to tenth SFs, the selective setup operations are performed similarly to the setup period of the second SF. In write periods of the third to tenth SFs, the sustain electrode SUi is held at the potential Ve2 similarly to the second SF to perform the write operations. In sustain periods of the third to tenth SFs, the same sustain operations as that in the sustain period of the first SF except for the number of the sustain pulses are performed.

(4) Other Examples of the Driving Waveforms
(Adjustment of the Wall Charges)

Figure 6:
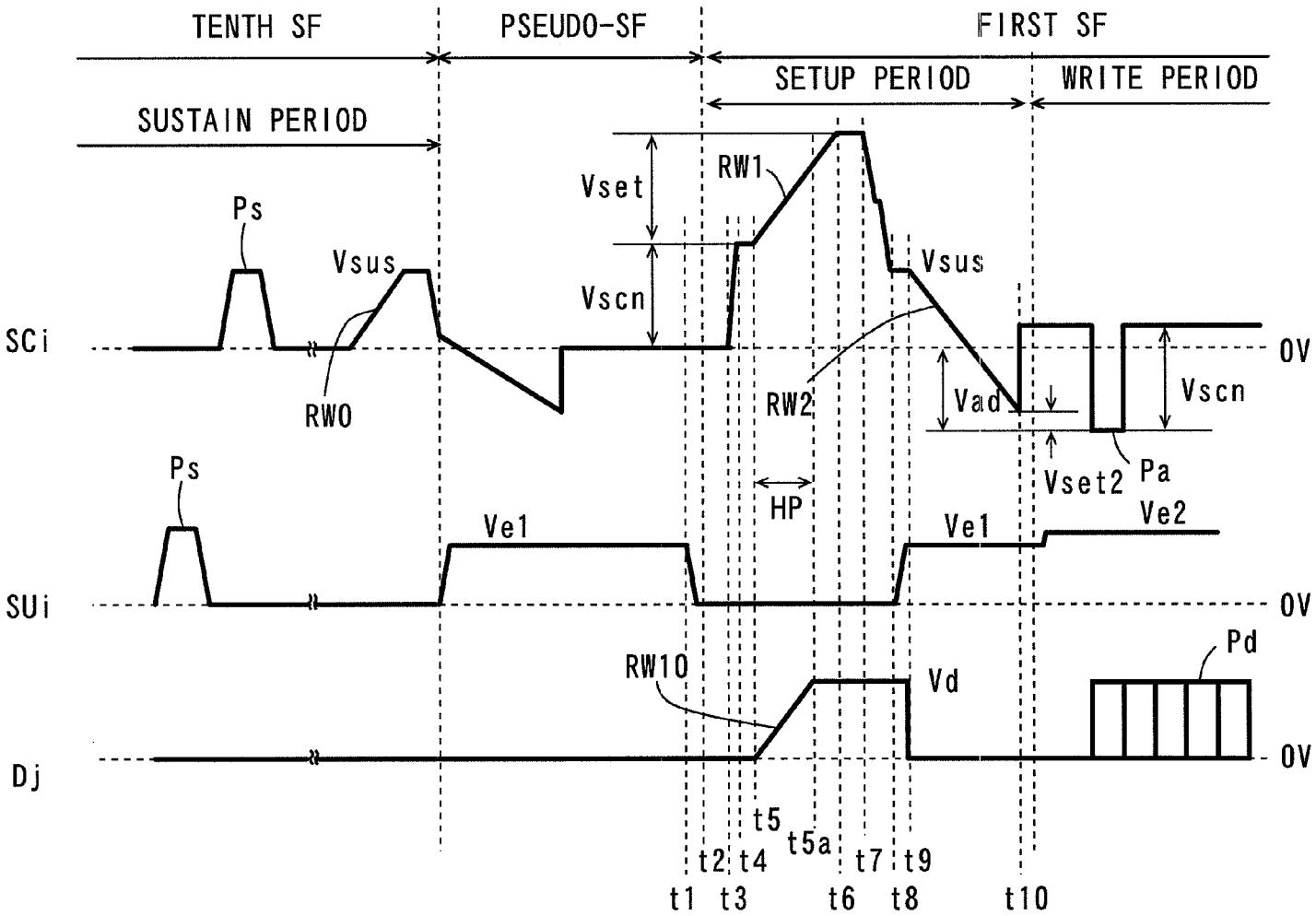
FIG. 6 is a partially enlarged view showing other examples of the driving waveforms applied to the respective electrodes of the plasma display apparatus according to the one embodiment of the present invention.

The wall charges on the scan electrode SCi and the sustain electrode SUi may be adjusted before the start of the pseudo-SF by applying driving waveforms described below to the respective electrodes. FIG. 6 is a partially enlarged view showing other examples of the driving waveforms applied to the respective electrodes of the plasma display apparatus according to the one embodiment of the present invention.

In this example, a ramp waveform RW0 is applied at the end of the tenth SF of the preceding field in order to perform the weak erase discharge before the selective setup in the pseudo-SF of the preceding field as shown in FIG. 6. The ramp waveform RW0 gradually rises from the ground potential toward the positive potential (Vsus). At this time, the sustain electrode SUi and the data electrode Dj are maintained at the ground potential.

Here, the positive wall charges are stored on the scan electrode SCi and the negative wall charges are stored on the sustain electrode SUi in the discharge cell DC in which the sustain discharge has been induced. Thus, as described above, when the ramp waveform RW0 is applied to the scan electrode SCi, the voltage between the scan electrode SCi and the sustain electrode SUi exceeds the discharge start voltage in the discharge cell DC in which the sustain discharge has been induced, thus generating the weak erase discharge between the sustain electrode SUi and the scan electrode SCi.

The positive wall charges stored on the scan electrode SCi and the negative wall charges stored on the sustain electrode SUi are slightly reduced. Thus, a large amount of positive wall charges remains on the scan electrode SCi, and a large amount of negative wall charges remains on the sustain electrode SUi. At this time, the positive wall charges are stored on the data electrode Dj.

In this manner, similarly to the example of FIGS. 4 and 5, the selective setup operation is performed in the subsequent pseudo-SF, and the setup operation for all cells is performed in the setup period of the first SF in the following field, so that the wall voltage on the scan electrode SCi, the wall voltage on the sustain electrode SUi and the wall voltage on the data electrode Dj are adjusted to the respective values suitable for the write operation.

(5) Other Examples of the Driving Waveforms
(Setting of the Setup Period in the Field)

In the example of FIG. 4, the setup period in which the setup operation for all cells is performed is provided in the beginning of the first SF, which is an initial sub-field in the field. Hereinafter, description is made of an example in which the setup period in which the setup operation for all cells is performed is provided between predetermined sub-fields in the field.

Figure 7:
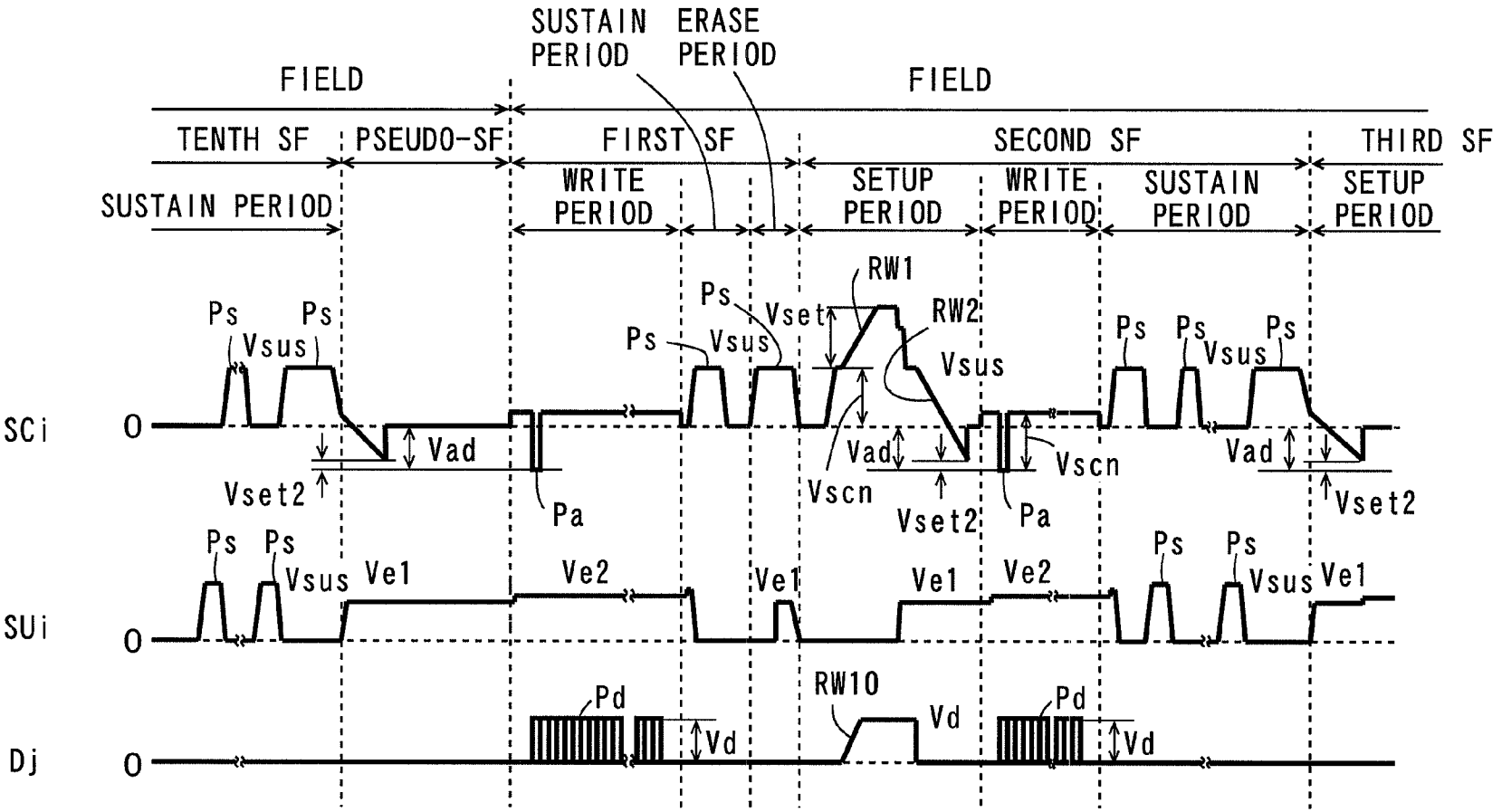
FIG. 7 is a diagram showing still other examples of the driving waveforms applied to the respective electrodes of the plasma display apparatus according to the one embodiment of the present invention.
Figure 8:
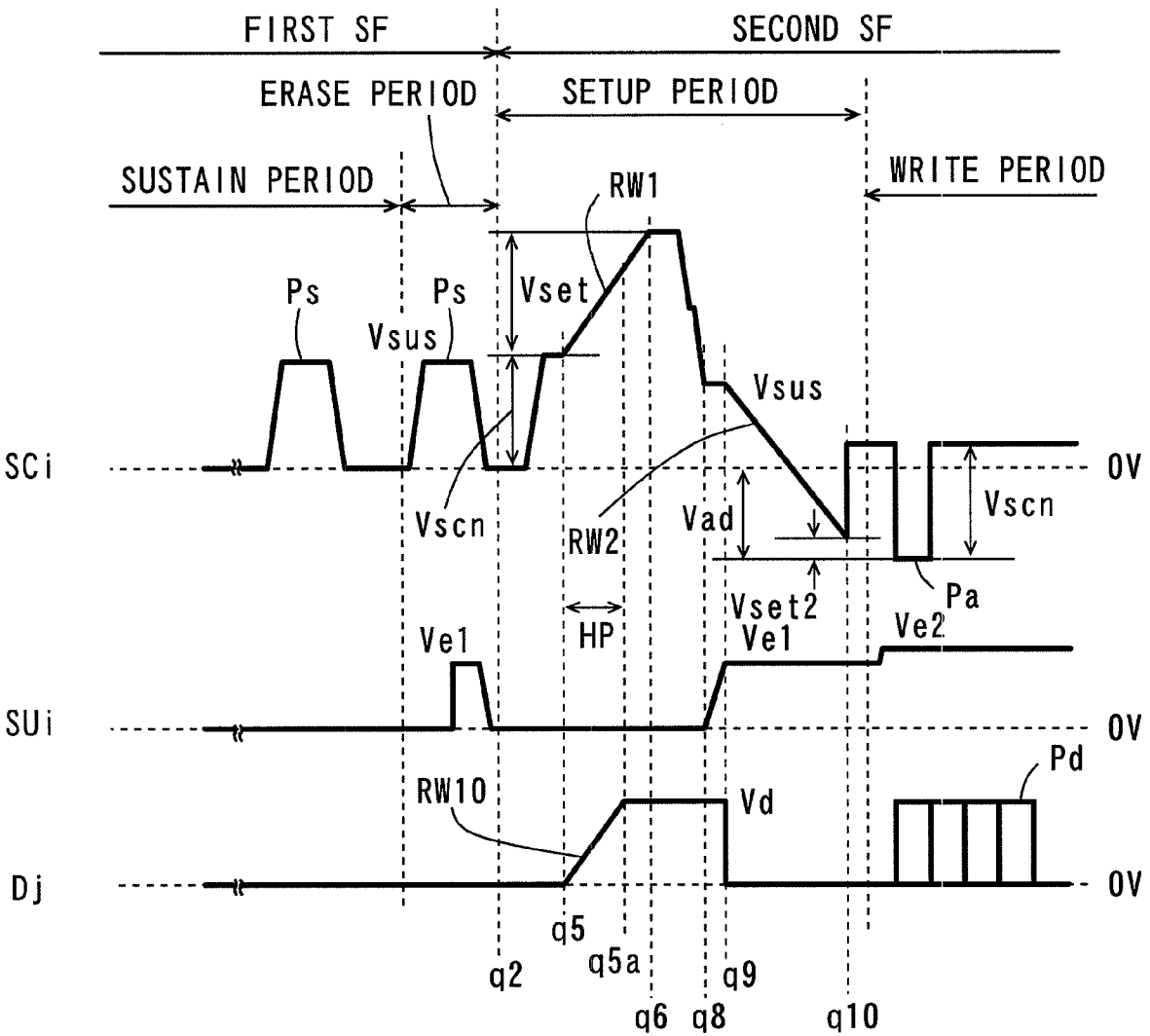
FIG. 8 is a partially enlarged view of the driving waveforms of FIG. 7.

FIG. 7 is a diagram showing still other examples of the driving waveforms applied to the respective electrodes of the plasma display apparatus according to the one embodiment of the present invention, and FIG. 8 is a partially enlarged view of the driving waveforms of FIG. 7.

The driving waveforms shown in FIGS. 7 and 8 are described while referring to differences from the driving waveforms shown in FIGS. 4 and 5. As shown in FIG. 7, the first SF does not have the setup period in which the setup operation for all cells is performed, and the second SF has the setup period in which the setup operation for all cells is performed in the driving waveforms of this example.

FIG. 7 shows the period from the sustain period of the tenth SF of the field preceding the one field to the setup period of the third SF of the one field.

In the write period of the first SF, the negative scan pulse Pa (=−Vad) is applied to the scan electrode SCi and the positive write pulse Pd (Vd) is applied to the data electrode Dk (k is any of 1 to m), similarly to the write period described referring to FIG. 5.

This generates the write discharges between the scan electrode SCi and the data electrode Dk and between the scan electrode SCi and the sustain electrode SUi. The write operation is sequentially performed in the discharge cells on the first row to the n-th row, and the write period is then finished.

In the subsequent sustain period, the sustain electrode SUi is returned to the ground potential, and the sustain pulse Ps (=Vsus) is applied to the scan electrode SCi, similarly to the sustain period described referring to FIG. 4. At this time, the sustain discharge is induced between the scan electrode SCi and the sustain electrode SUi in the discharge cell DC in which the write discharge has been generated in the write period, causing the discharge cell DC to emit light. Similarly to this, a predetermined number of sustain pulses Ps are alternately applied to the scan electrode SCi and the sustain electrode SUi, so that the sustain discharges are continuously performed in the discharge cell DC in which the write discharge has been generated in the write period.

Here, in this first SF, an erase period following the sustain period is provided before the start of the second SF as shown in FIG. 8.

In the erase period, the potential of the sustain electrode SUi rises to the positive potential Ve1 after a predetermined period of time (a period of time corresponding to the phase difference TR of FIG. 5) has elapsed since the rise of the potential of the scan electrode SCi to the positive potential Vsus, similarly to the end of the sustain period of the tenth SF of the preceding field described referring to FIGS. 4 and 5.

Thus, the weak erase discharge is generated between the scan electrode SCi and the sustain electrode SUi. This allows a large amount of positive wall charges to remain on the scan electrode SCi and a large amount of negative wall charges to remain on the sustain electrode SUi. In this state, the first SF is finished.

After that, as shown in FIG. 8, the setup operation for all cells that is the same as the example of FIGS. 4 and 5 is performed in the setup period provided in the beginning of the second SF.

Specifically, the potential of the sustain electrode SUi attains the ground potential at a starting time point q2 of the setup period, and the positive ramp waveform RW1 is applied to the scan electrode SCi in a period from a time point q5 to a time point q6. The data electrode Dj is brought into the high impedance state in a period from the time point q5 to a time point q5*a* (a high impedance period HP).

Then, the potential of the sustain electrode SUi rises to the positive potential Ve1 in a period from a time point q8 to a time point q9, and the potential of the data electrode Dj drops to the ground potential at the time point q9. Moreover, the negative ramp waveform RW2 is applied to the scan electrode SCi in a period from the time point q9 to a time point q10.

Here, the time points q2, q5, q5*a*, q6, q8, q9, q10 of FIG. 8 correspond to the time points t2, t5, t5*a*, t6, t8, t9, t10 of FIG. 5, respectively.

Thereafter, the write operation and the sustain operation that are the same as the example in FIGS. 4 and 5 are performed in the write period and the sustain period in the second SF as shown in FIG. 7.

Each of the third to tenth SFs following the second SF has a setup period in which the selective setup operation is performed, a write period and a sustain period.

As described above, the setup period where the setup operation for all cells is performed may be provided between predetermined sub-fields in a field in the plasma display apparatus according to the present embodiment.

(6) Effects

In the plasma display apparatus according to the present embodiment, the weak erase discharge is generated between the scan electrode SCi and the sustain electrode SUi to decrease the wall charges on the scan electrode SCi and the wall charges on the sustain electrode SUi before the start of the setup period. Thus, the large amount of positive wall charges can remain in the scan electrode SCi and the large amount of negative wall charges can remain in the sustain electrode SUi.

Moreover, the potentials of the sustain electrode SUi and the data electrode Dj are maintained at the ground potential before the starting time point (the time point t5 of FIGS. 5 and 6 and the time point q5 of FIG. 8) of the rise period in the setup period in which the setup operation for all cells is performed.

Then, the data electrode Dj is brought into the high impedance state for the given period of time (the high impedance period HP) from the starting time point of the rise period. This causes the potential of the data electrode Dj to change according to the potential change of the scan electrode SCi. In the present embodiment, the potential of the data electrode Dj gradually rises as the ramp waveform RW10 of FIGS. 5, 6 and 8 does. In this case, the voltage between the scan electrode SCi and the data electrode Dj is held substantially constant.

Accordingly, the discharge is not generated between the scan electrode SCi and the data electrode Dj in the high impedance period HP even when the large amount of positive wall charges is stored on the scan electrode SCi. Therefore, the potential of the scan electrode SCi rises to cause the voltage between the scan electrode SCi and the sustain electrode SUi to reliably exceed the discharge start voltage. This causes the weak setup discharge to be generated between the scan electrode SCi and the sustain electrode SUi.

In this case, the positive wall charges on the scan electrode SCi are decreased and the negative wall charges on the sustain electrode SUi are decreased. This reliably prevents the strong discharge from occurring between the sustain electrode SUi and the data electrode Dj in the high impedance period HP. Accordingly, the strong discharge resulting from the occurrence of the strong discharge between the sustain electrode SUi and the data electrode Dj is prevented from occurring between the scan electrode SCi and the sustain electrode SUi, and the wall charges on the scan electrode SCi is prevented from being zero.

This eliminates the necessity of setting the high potential of the ramp waveform RW1 applied to the scan electrode SCi for generating the weak setup discharge between the scan electrode SCi and the sustain electrode SUi. As a result, rising cost of the scan electrode driving circuit 53 is avoided.

Then, the potential of the data electrode Dj is maintained at the positive potential Vd after the high impedance period HP within the rise period. Thus, the voltage between the scan electrode SCi and the data electrode Dj reliably exceeds the discharge start voltage with rising the potential of the scan electrode SCi. This causes the weak setup discharge to be generated between the scan electrode SCi and the data electrode Dj. As a result, the amounts of the wall charges on the scan electrode SCi, the sustain electrode SUi and the data electrode Dj are adjusted to be suitable for the write operation.

In this manner, the write discharges between the scan electrode SCi and the data electrode Di and between the sustain electrode SUi and the scan electrode SCi are weakened in the write period. As a result, an occurrence of crosstalk between the adjacent discharge cells DC is prevented even when a distance between the adjacent discharge cells DC is small.

Figure 9:
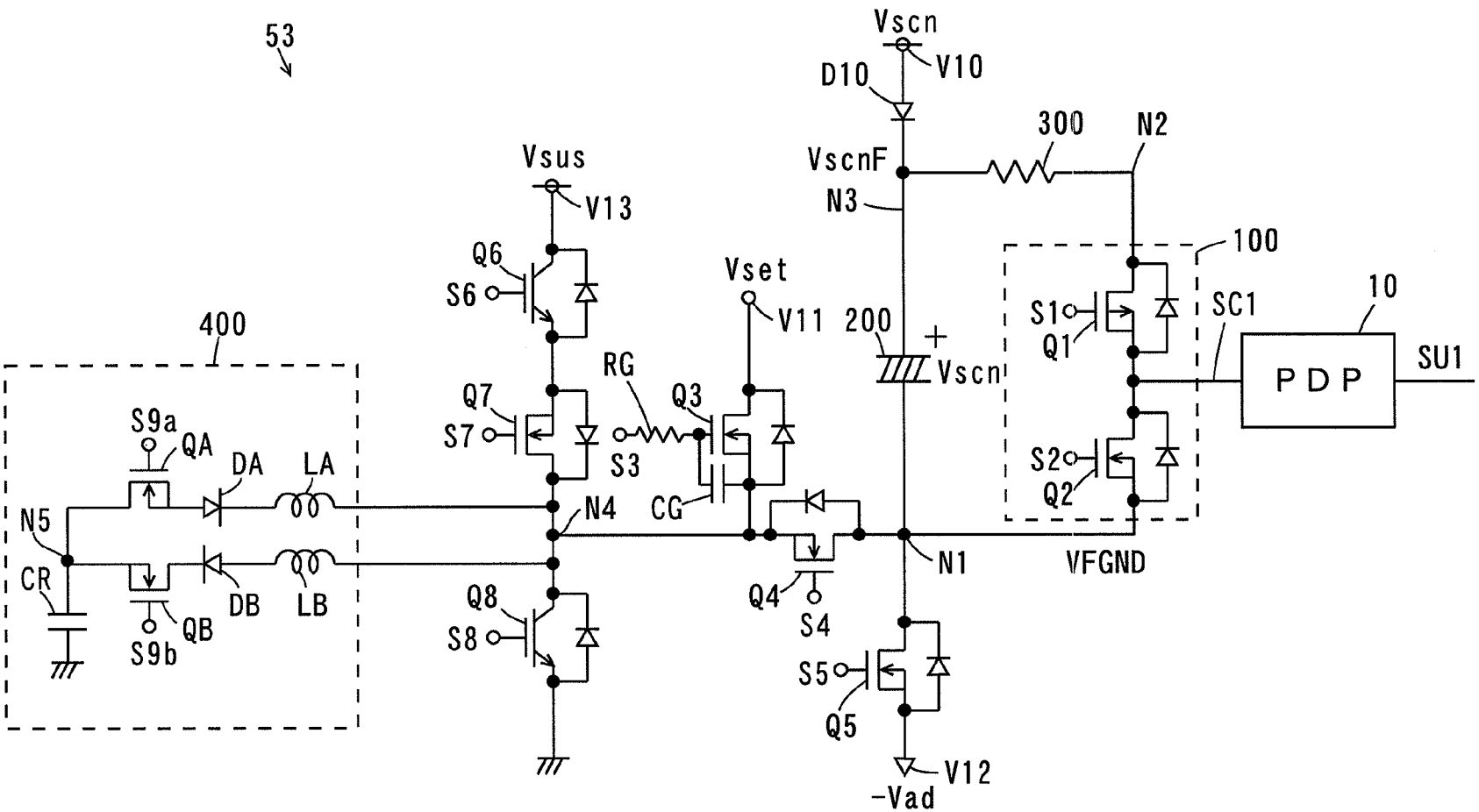
FIG. 9 is a circuit diagram showing the configuration of a scan electrode driving circuit of FIG. 3.

(7) Circuit Configuration and Operation of the Scan Electrode Driving Circuit (7-1) Circuit Configuration FIG. 9 is a circuit diagram showing the configuration of the scan electrode driving circuit 53 of FIG. 3.

The scan electrode driving circuit 53 includes a scan IC (Integrated Circuit) 100, a DC power supply 200, a protective resistor 300, a recovery circuit 400, a diode D10, n-channel field effect transistors (hereinafter abbreviated as transistors) Q3 to Q5, Q7 and NPN bipolar transistors (hereinafter abbreviated as transistors) Q6, Q8. One scan IC 100 connected to the one scan electrode SC1 in the scan electrode driving circuit 53 is shown in FIG. 9. The scan ICs that are the same as the scan IC 100 of FIG. 9 are connected to the other scan electrodes SC2 to SCn, respectively.

The scan IC 100 includes a p-channel field effect transistor (hereinafter abbreviated as a transistor) Q1 and an n-channel field effect transistor (hereinafter abbreviated as a transistor) Q2. The recovery circuit 400 includes n-channel field effect transistors (hereinafter abbreviated as transistors) QA, QB, recovery coils LA, LB, a recovery capacitor CR and diodes DA, DB.

The scan IC 100 is connected between a node N1 and a node N2. The transistor Q1 of the scan IC 100 is connected between the node N2 and the scan electrode SC1, and the transistor Q2 is connected between the scan electrode SC1 and the node N1. A control signal S1 is applied to a gate of the transistor Q1, and a control signal S2 is applied to a gate of the transistor Q2.

The protective resistor 300 is connected between the node N2 and a node N3. A power supply terminal V10 that receives the voltage Vscn is connected to the node N3 through the diode D10. The DC power supply 200 is connected between the node N1 and the node N3. The DC power supply 200 is composed of an electrolytic capacitor, and functions as a floating power supply that holds the voltage Vscn. Hereinafter, a potential of the node N1 is referred to as VFGND, and a potential of the node N3 is referred to as VscnF. The potential VscnF of the node N3 has a value obtained by adding the voltage Vscn to the potential VFGND of the node N1. That is, VscnF=VFGND+Vscn.

The transistor Q3 is connected between a power supply terminal V11 that receives the voltage Vset and a node N4, and a control signal S3 is supplied to a gate. The transistor Q4 is connected between the node N1 and the node N4, and a control signal S4 is supplied to a gate. The transistor Q5 is connected between the node N1 and a power supply terminal V12 that receives the negative voltage (−Vad), and a control signal S5 is applied to a gate. The control signal S4 is an inverted signal of the control signal S5.

The transistors Q6, Q7 are connected between a power supply terminal V13 that receives the voltage Vsus and the node N4. A control signal S6 is supplied to a base of the transistor Q6, and a control signal S7 is supplied to a gate of the transistor Q7. The transistor Q8 is connected between the node N4 and a ground terminal, and a control signal Q8 is supplied to a base.

Between the node N4 and a node N5, the recovery coil LA, the diode DA and the transistor QA are connected in series, and the recovery coil LB, the diode DB and the transistor QB are connected in series. A control signal S9*a* is supplied to a gate of the transistor QA, and a control signal S9*b* is supplied to a gate of the transistor QB. The recovery capacitor CR is connected between the node N5 and the ground terminal.

A gate resistor RG and a capacitor CG are connected to the transistor Q3 as shown in FIG. 9. Gate resistors and capacitors, not shown, are connected to the other transistors Q5, Q6, respectively.

The foregoing control signals S1 to S8, S9*a*, S9*b* are supplied from the timing generating circuit 55 of FIG. 3 to the scan electrode driving circuit 53 as the timing signals.

(7-2) Operation in the Setup Period

Figure 10:
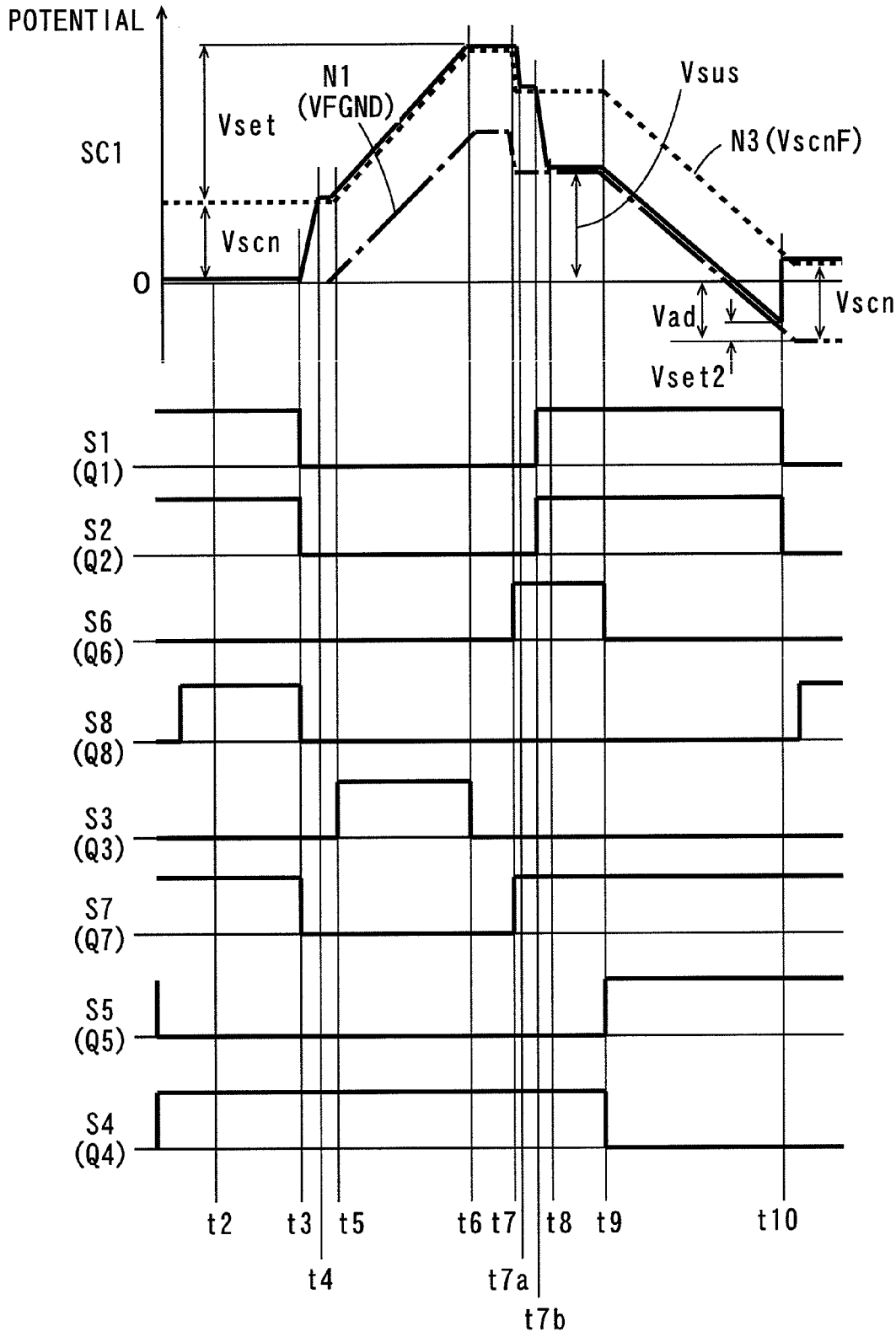
FIG. 10 is a detailed timing chart of control signals supplied to the scan electrode driving circuit in a setup period of a first SF of FIGS. 4 and 5.

FIG. 10 is a detailed timing chart of the control signals supplied to the scan electrode driving circuit 53 in the setup period of the first SF of FIGS. 4 and 5.

Change of the potential VFGND of the node N1 is indicated by the one-dot and dash line, the potential VscnF of the node N3 is indicated by the dotted line, and change of the potential of the scan electrode SC1 is indicated by the solid line in the top stage of FIG. 10. Note that the control signals S9*a*, S9*b* supplied to the recovery circuit 400 are not shown in FIG. 10.

At the starting time point t2 of the first SF, the control signals S6, S3, S5 are at a low level, and the control signals S1, S2, S8, S7, S4 are at a high level. This causes the transistors Q1, Q6, Q3, Q5 to be turned off and the transistors Q2, Q8, Q7, Q4 to be turned on. Thus, the node N1 attains the ground potential (0 V) and the potential VscnF of the node N3 attains Vscn. Since the transistor Q2 is turned on, the potential of the scan electrode SC1 attains the ground potential.

The control signals S8, S7 attain a low level and the transistors Q8, Q7 are turned off at the time point t3. Moreover, the control signals S1, S2 attain a low level. This causes the transistor Q1 to be turned on and the transistor Q2 to be turned off. Accordingly, the potential of the scan electrode SC1 rises to Vscn. The potential of the scan electrode SC1 is maintained at Vscn in a period from the time point t4 to the time point t5.

The control signal S3 attains a high level and the transistor Q3 is turned on at the time point t5. This causes the potential VFGND of the node N1 to gradually rise from the ground potential to Vset. In addition, the potential VscnF of the node N3 and the potential of the scan electrode SC1 rise from Vscn to (Vscn+Vset).

The control signal S3 attains a low level and the transistor Q3 is turned off at the time point t6. This causes the potential VFGND of the node N1 to be held at Vset. Moreover, the potential VscnF of the node N3 and the potential of the scan electrode SC1 are maintained at (Vscn+Vset).

The control signals S6, S7 attain a high level and the transistors Q6, Q7 are turned on at the time point t7. This causes the potential VFGND of the node N1 to drop to Vsus. In addition, the potential VscnF of the node N3 and the potential of the scan electrode SC1 drop to (Vscn+Vsus). The potential of the scan electrode SC1 is maintained at (Vscn+Vsus) in a period from a time point t7*a* to a time point t7*b*.

The control signals S1, S2 attain a high level at the time point t7*b*. This causes the transistor Q1 to be turned off and the transistor Q2 to be turned on. Thus, the potential of the scan electrode SC1 drops to Vsus. Accordingly, the potential of the scan electrode SC1 is maintained at Vsus in the period from the time point t8 to the time point t9.

The control signals S4, S6 attain a low level and the transistors Q4, Q6 are turned off at the time point t9. Moreover, the control signal S5 attains a high level, and the transistor Q5 is turned on. This causes the potential VFGND of the node N1 and the potential of the scan electrode SC1 to gradually drop toward (−Vad). In addition, the potential VscnF of the node N3 gradually drops toward (−Vad+Vscn).

The control signals S1, S2 attains a low level at the time point t10. This causes the transistor Q1 to be turned on and the transistor Q2 to be turned off. Accordingly, the potential of the scan electrode SC1 rises from (−Vad+Vset2) to (−Vad+Vscn). Here, Vset2<Vscn. The setup period is finished in this state.

Figure 11:
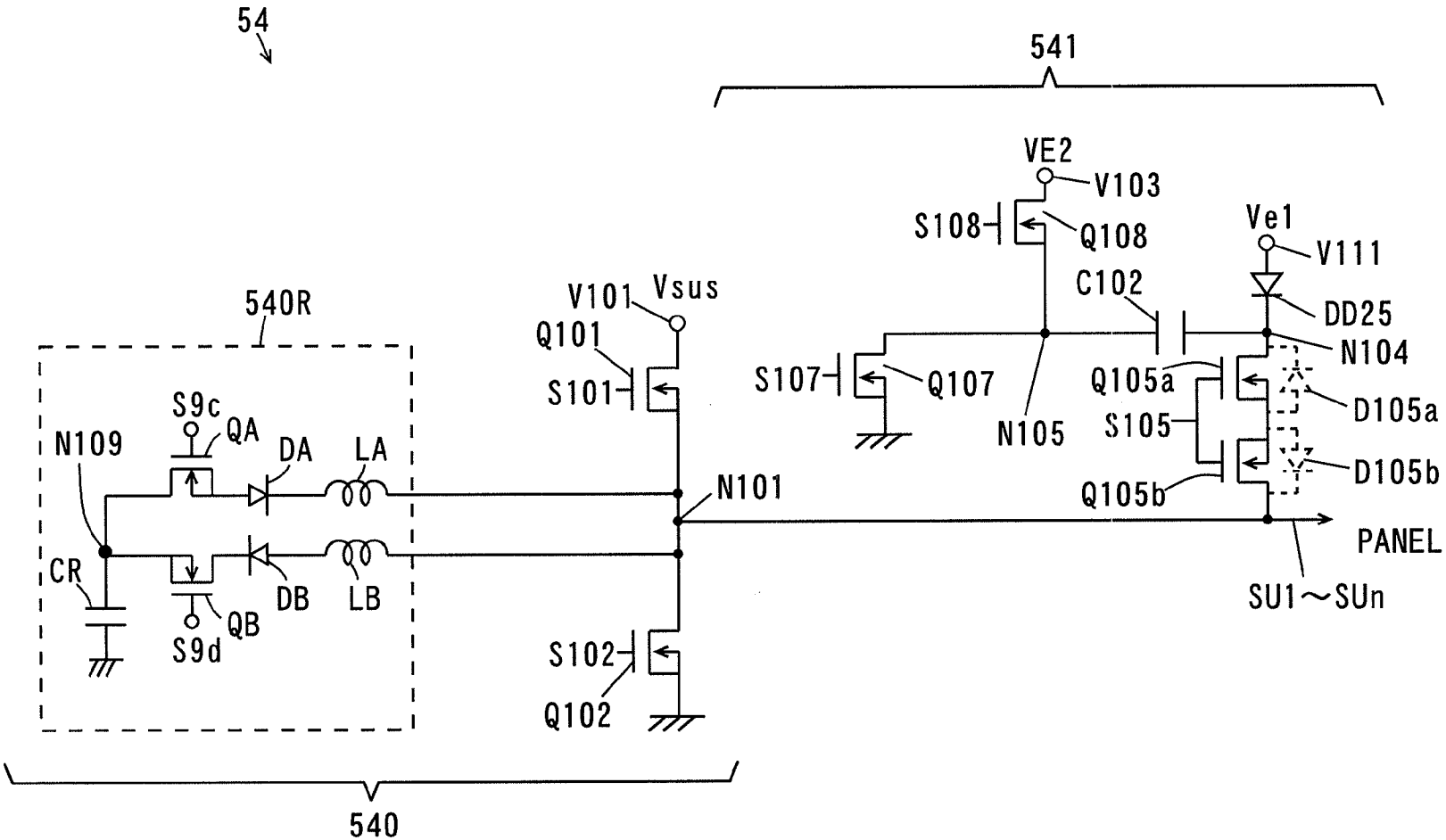
FIG. 11 is a circuit diagram showing the configuration of a sustain electrode driving circuit of FIG. 3.

(8) Circuit Configuration and Operation of the Sustain Electrode Driving Circuit (8-1) Circuit Configuration FIG. 11 is a circuit diagram showing the configuration of the sustain electrode driving circuit 54 of FIG. 3.

The sustain electrode driving circuit 54 of FIG. 11 includes a sustain driver 540 and a voltage raising circuit 541.

As shown in FIG. 11, the sustain driver 540 includes n-channel field effect transistors (hereinafter abbreviated as transistors) Q101, Q102 and a recovery circuit 540R. The recovery circuit 540R includes n-channel field effect transistors (hereinafter abbreviated as transistors) QA, QB, recovery coils LA, LB, a recovery capacitor CR and diodes DA, DB.

The transistor Q101 of the sustain driver 540 is connected between a power supply terminal V101 that receives the voltage Vsus and a node N101, and a control signal S101 is supplied to a gate.

The transistor Q102 is connected between the node N101 and a ground terminal, and a control signal S102 is supplied to a gate. The node N101 is connected to the sustain electrodes SU1 to SUn of FIG. 2.

Between the node N101 and a node N109 of the recovery circuit 540R, the recovery coil LA, the diode DA and the transistor QA are connected in series, and the recovery coil LB, the diode DB and the transistor QB are connected in series. The recovery capacitor CR is connected between the node N109 and a ground terminal. A control signal S9*c* is supplied to a gate of the transistor QA and a control signal S9*d* is supplied to a gate of the transistor QB.

The voltage raising circuit 541 includes n-channel field-effect transistors (hereinafter abbreviated as transistors) Q105*a*, Q105*b*, Q107, Q108, a diode DD25 and a capacitor C102.

The diode DD25 of the voltage raising circuit 541 is connected between a power supply terminal V111 that receives the voltage Ve1 and a node N104.

The transistor Q105*a* and the transistor Q105*b* are connected in series between the node N104 and the node N101. Control signals S105 are supplied to gates of the transistor Q105*a* and the transistor Q105*b*, respectively. The capacitor C102 is connected between the node N104 and a node N105.

The transistor Q107 is connected between the node N105 and a ground terminal, and a control signal S107 is input to a gate. The transistor Q108 is connected between a power supply terminal V103 that receives the voltage VE2 and the node N105, and a control signal S108 is input to a gate. Note that the voltage VE2 satisfies a relation of VE2=Ve2−Ve1, such as VE2=5 [V].

The above-mentioned control signals S101, S102, S9*c*, S9*d*, S105, S107, S108 are supplied from the timing generating circuit 55 of FIG. 3 to the sustain electrode driving circuit 54 as the timing signals.

(8-2) Operation in the Setup Period

Figure 12:
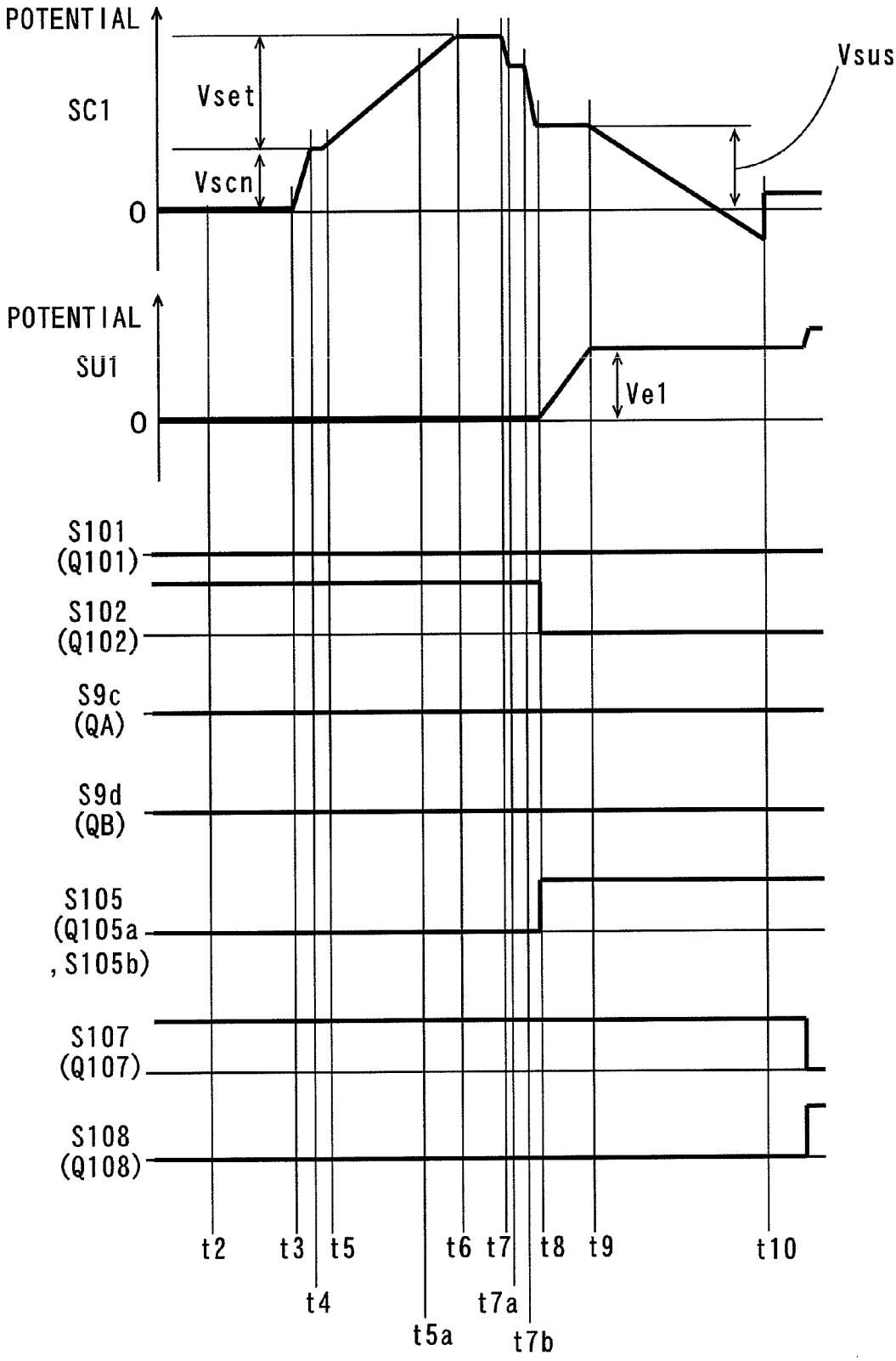
FIG. 12 is a detailed timing chart of control signals supplied to the sustain electrode driving circuit in the setup period of the first SF of FIGS. 4 and 5.

FIG. 12 is a detailed timing chart of the control signals supplied to the sustain electrode driving circuit 54 in the setup period of the first SF of FIGS. 4 and 5.

Change of the potential of the scan electrode SC1 is shown in the top stage of FIG. 12 for reference. Change of the potential of the sustain electrode SU1 is shown in the next stage of FIG. 12.

At the starting time point t2 of the first SF, the control signals S101, S9*c*, S9*d*, S105, S108 are at a low level, and the control signals S102, S107 are at a high level. This causes the transistors Q101, QA, QB, Q105*a*, Q105*b*, Q108 to be turned off and the transistors Q102, Q107 to be turned on. Thus, the sustain electrode SU1 (the node N101) attains the ground potential.

The control signal S102 attains a low level and the control signal S105 attains a high level at the time point t8 after the predetermined period of time (the rise period) has elapsed since the starting time point t2 of the first SF. Thus, the transistor Q102 is turned off and the transistors Q105*a*, Q105*b* are turned on. This causes a current to pass from the power supply terminal V111 to the sustain electrode SU1 through the node N104. As a result, the potential of the sustain electrode SU1 rises to be held at Ve1 at the time point t9. The setup period is finished in this state.

Figure 13:
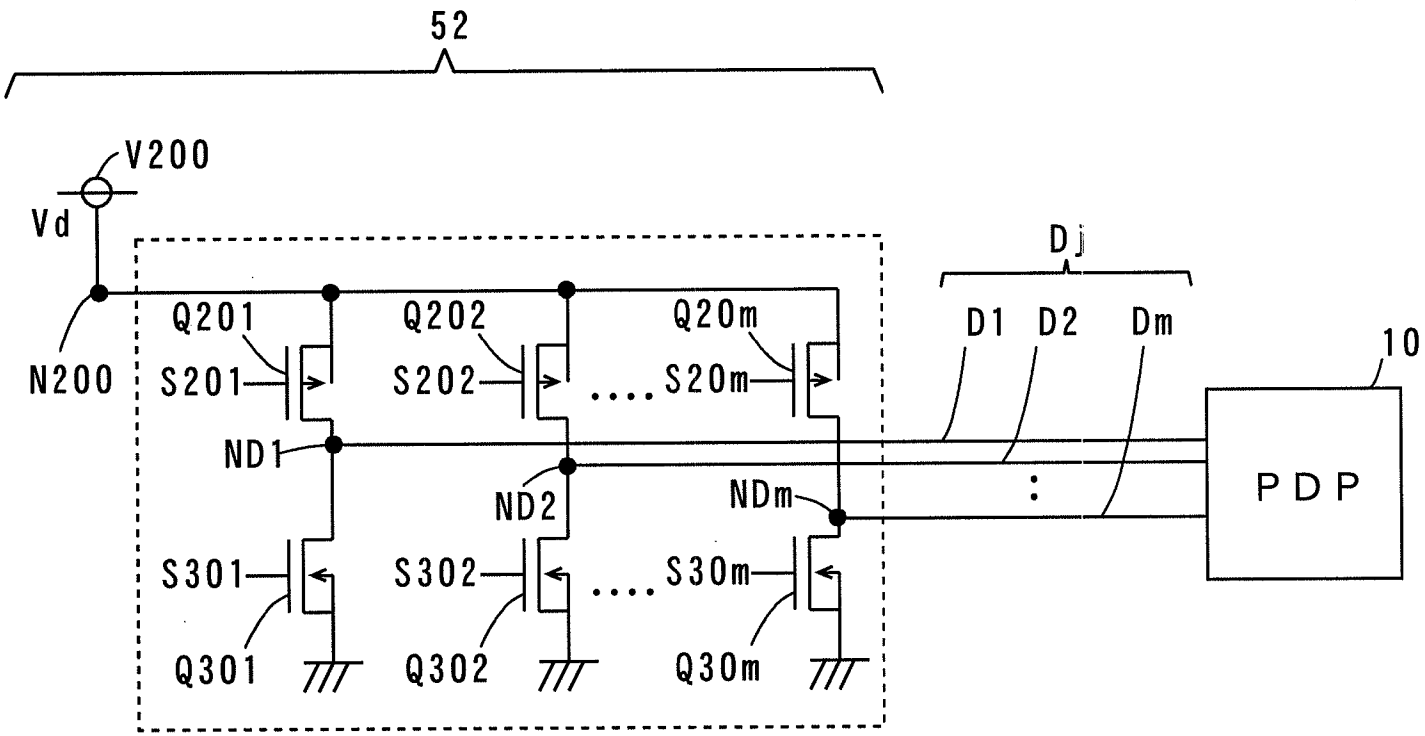
FIG. 13 is a circuit diagram showing the configuration of a data electrode driving circuit of FIG. 3.

(9) Circuit Configuration and Operation of the Data Electrode Driving Circuit (9-1) Circuit Configuration FIG. 13 is a circuit diagram showing the configuration of the data electrode driving circuit 52 of FIG. 3.

The data electrode driving circuit 52 of FIG. 13 includes a plurality of p-channel field-effect transistors (hereinafter abbreviated as transistors) Q201 to Q20*m* and a plurality of n-channel field effect transistors (hereinafter abbreviated as transistors) Q301 to Q30*m*.

A power supply terminal V200 that receives the voltage Vd is connected to a node N200. The transistors Q201 to Q20*m* are connected between the node N200 and nodes ND1 to NDm, respectively, and control signals S201 to S20*m* are supplied to gates. The nodes ND1 to NDm are connected to the data electrodes D1 to Dm of FIG. 2, respectively.

The transistors Q301 to Q30*m* are connected between the nodes ND1 to NDm and the ground terminal, respectively, and control signals S301 to S30*m* are supplied to gates.

The foregoing control signals S201 to S20*m* are supplied from the timing generating circuit 55 of FIG. 2 to the data electrode driving circuit 52 as the timing signals.

(9-2) Operation Control

Figure 14:
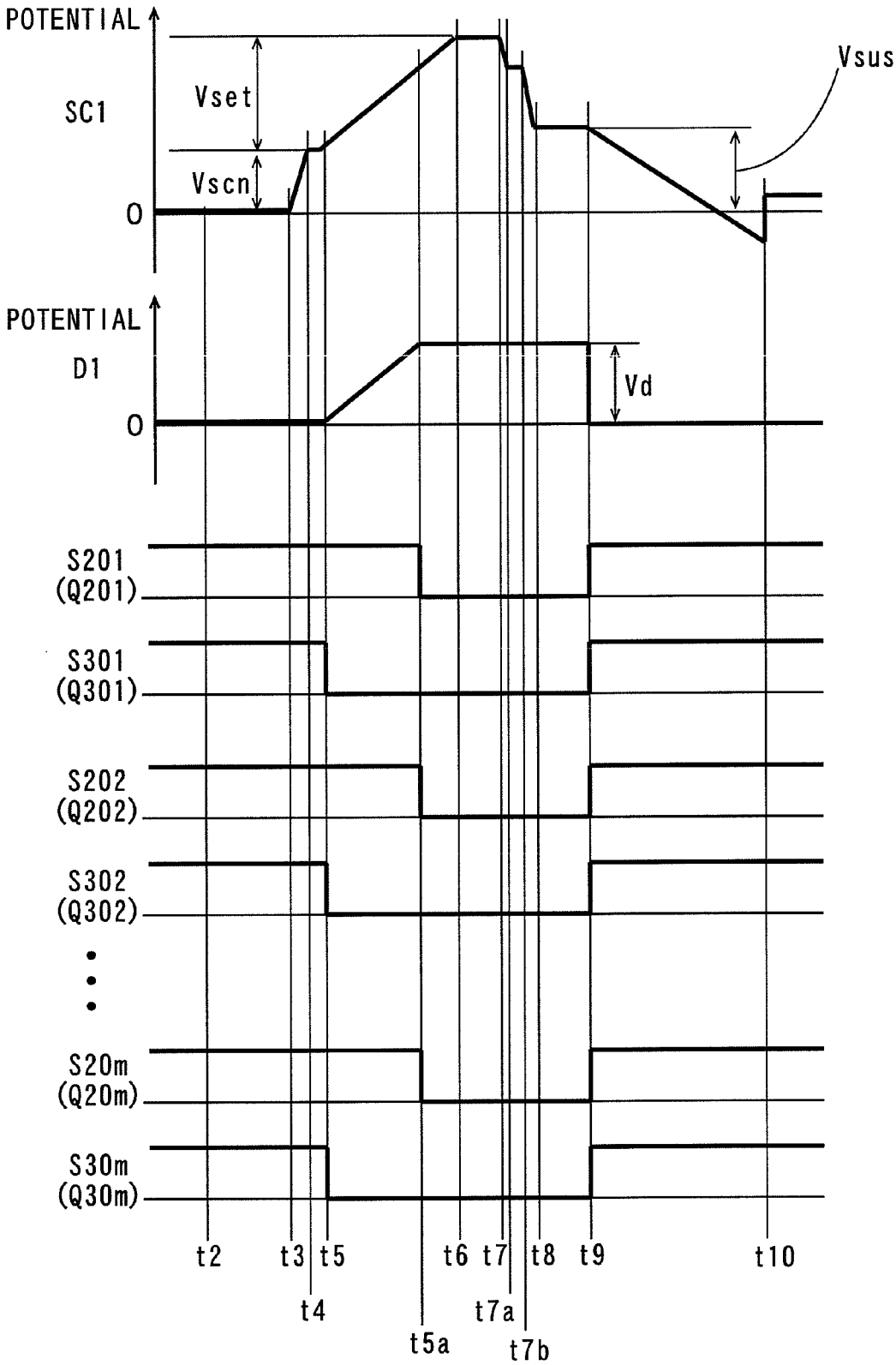
FIG. 14 is a detailed timing chart of control signals supplied to the data electrode driving circuit in the setup period of the first SF of FIGS. 4 and 5.
Figure 15:
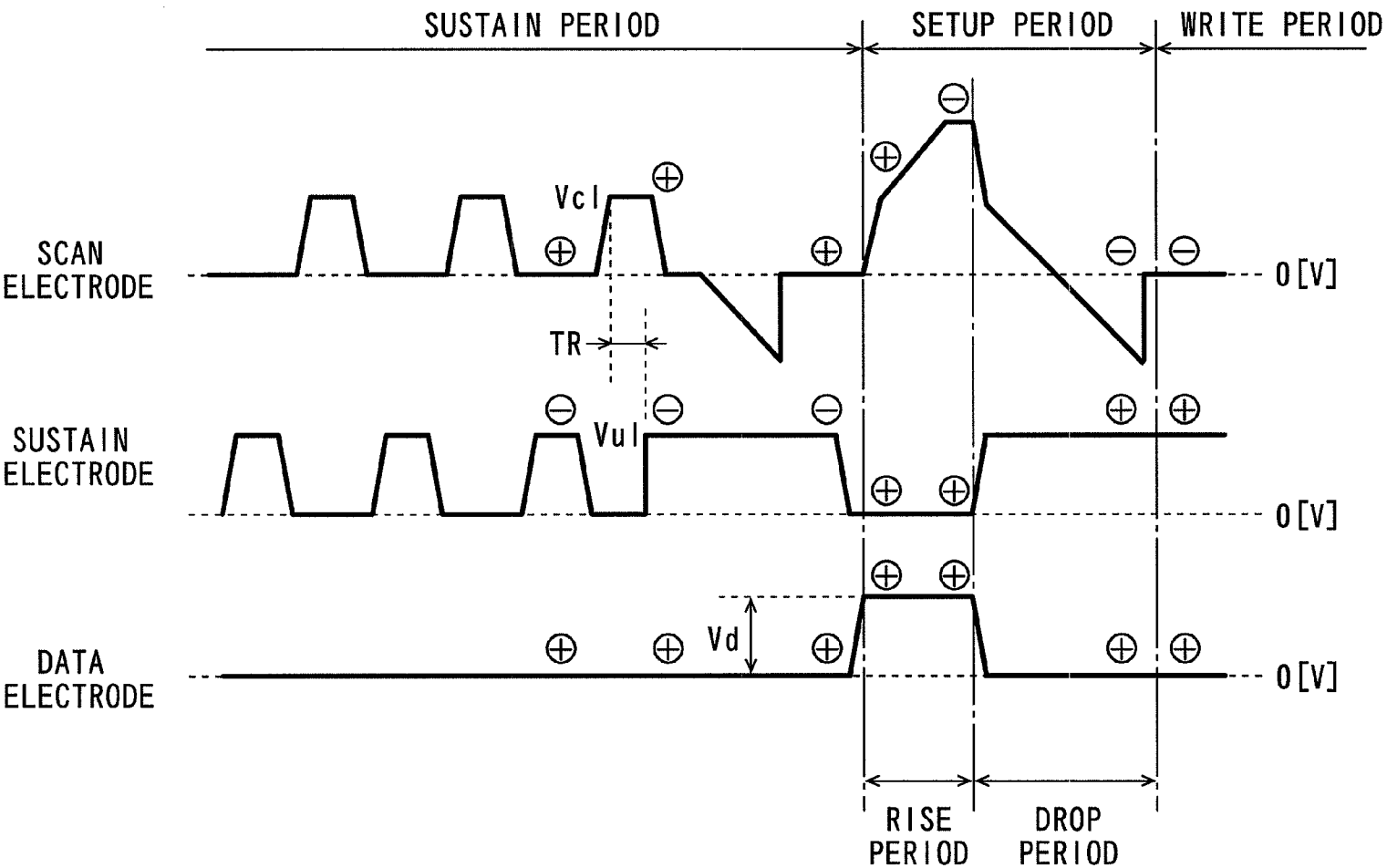
FIG. 15 PRIOR ART
FIG. 15 shows examples of driving waveforms of a panel employing a driving method of the panel of Patent Document 2.
Figure 16:
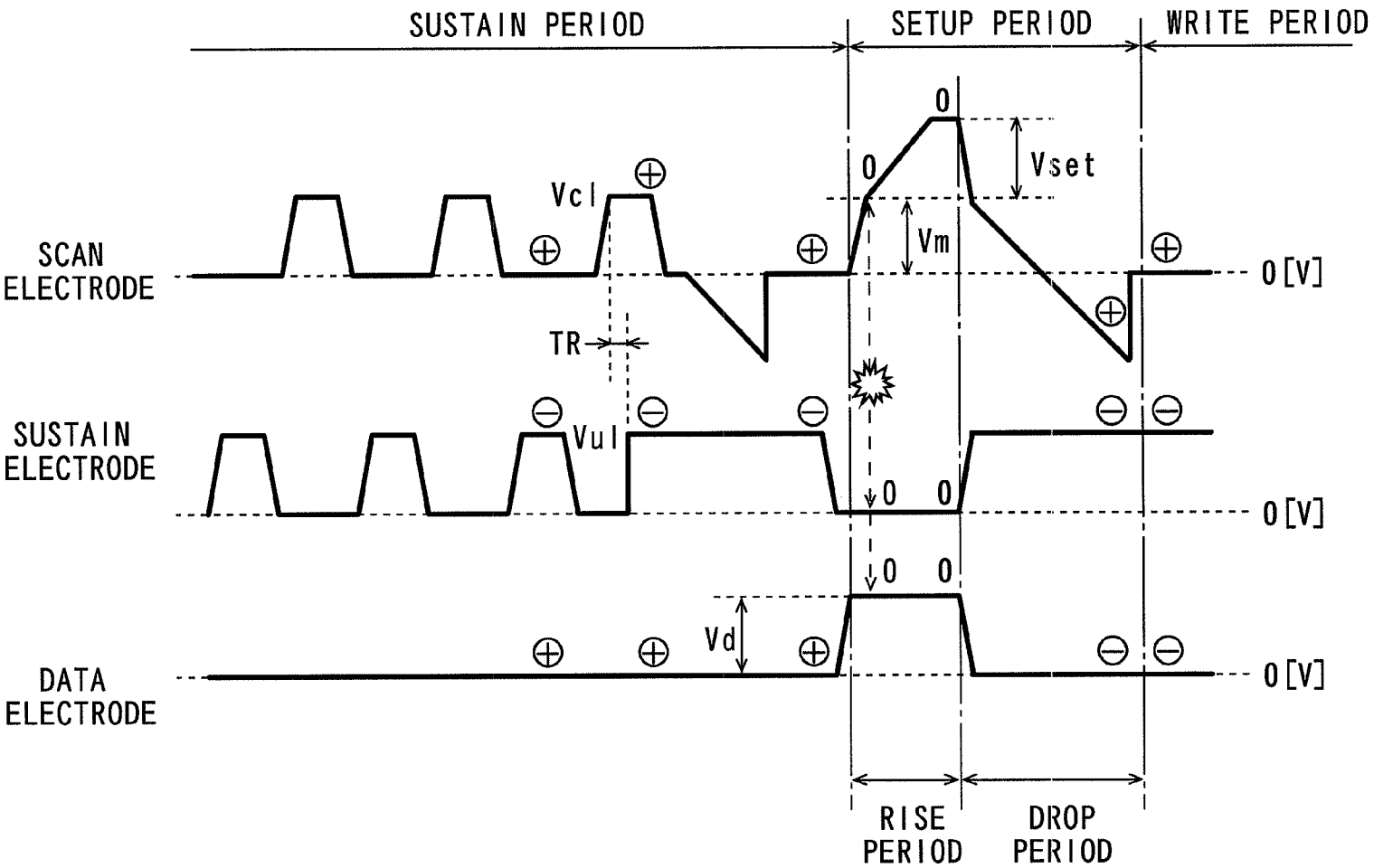
FIG. 16 PRIOR ART
FIG. 16 shows examples of driving waveforms of a panel for preventing crosstalk from occurring between adjacent discharge cells.

FIG. 14 is a detailed timing chart of the control signals supplied to the data electrode driving circuit 52 in the setup period of the first SF of FIGS. 4 and 5.

Change of the potential of the scan electrode SC1 is shown in the top stage of FIG. 14 for reference. Change of the potential of the data electrode D1 is shown in the next stage of FIG. 14.

The control signals S201 to S20*m*, S301 to S30*m* attain a high level at the starting time point t2 of the first SF. This causes the transistors Q201 to Q20*m* to be turned off and the transistors Q301 to Q30*m* to be turned on. Thus, the data electrodes D1 to Dm (the nodes ND1 to NDm) attain the ground potential.

At the time point t5 where the rise period is started, the control signals S301 to S30*m* attain a low level. This causes the transistors Q301 to Q30*m* to be turned off. Thus, the data electrodes D1 to Dm (the nodes ND1 to NDm) are brought into the high impedance state. Accordingly, the potential of the data electrodes D1 to Dm gradually rises by the voltage Vd according to the rise of the potential of the scan electrodes SC1 to SCn.

Then, the control signals S201 to S20*m* attain a low level at the time point t5*a* during the rise period. Thus, the transistors Q201 to Q20*m* are turned on. This causes the current to pass from the power supply terminal V200 to the data electrodes D1 to Dm through the node N200. As a result, the potential of the data electrodes D1 to Dm are held at the positive potential Vd.

The control signals S201 to S20*m*, S301 to S30*m* attain a high level at the time point t9 where the drop period is started. This causes the transistors Q201 to Q20*m* to be turned off and the transistors Q301 to Q30*m* to be turned on. Thus, the potential of the data electrodes D1 to Dm (the nodes ND1 to NDm) attain the ground potential. In this state, the setup period is finished.

(10) Other Embodiments (10-1)

A ramp waveform or a step waveform gradually rising from the ground potential by the voltage Vd may be applied to the data electrode Dj in the high impedance period HP instead of bringing the data electrode Dj into the high impedance state. Also in this case, the same effects as the foregoing can be obtained.

While description is made of the setup operation for all cells that is performed in the first SF or the second SF in the present embodiment, the setup operation for all cells may not be performed in the first SF and the second SF but performed in another sub-field. Moreover, the setup operation for all cells may be performed in a plurality of sub-fields.

(10-2)

The n-channel field effect transistors and the p-channel field effect transistors are used as the switching elements in the data electrode driving circuit 52, the scan electrode driving circuit 53 and the sustain electrode driving circuit 54 in the foregoing embodiment, the switching elements are not limited to the foregoing examples.

For example, a p-channel field effect transistor, an insulated gate bipolar transistor or the like may be employed instead of the n-channel field effect transistor, and an n-channel field effect transistor, an insulated gate bipolar transistor or the like may be employed instead of the p-channel field effect transistor in the above-described circuits.

(11) Correspondences Between Elements in the Claims and Parts in Embodiments

In the following paragraphs, non-limiting examples of correspondences between various elements recited in the claims below and those described above with respect to various preferred embodiments of the present invention are explained.

In the foregoing embodiments, the image signal processing circuit 51, the data electrode driving circuit 52, the scan electrode driving circuit 53, the sustain electrode driving circuit 54, the timing generating circuit 55 and the power supply circuit are examples of a driving device, the rise period from the time point t5 to the time point t6 is an example of a first period, the positive potential Vscn is an example of a first potential, the positive potential (Vscn+Vset) is an example of a second potential, and the ramp waveform RW1 is an example of a first ramp waveform.

The positive potential Ve1 is an example of a third potential, the ground potential is an example of fourth and fifth potentials, the high impedance period HP from the time point t5 to the time point t5*a* is an example of a second period, the positive potential Vd is an example of a sixth potential, and the ramp waveform RW10 of the data electrode Dj in the high impedance period HP is an example of a second ramp waveform.

The positive potential Vsus is an example of seventh and eighth potentials, and the ramp waveform RW0 is an example of a third ramp waveform.

The panel 10, the image signal processing circuit 51, the data electrode driving circuit 52, the scan electrode driving circuit 53, the sustain electrode driving circuit 54, the timing generating circuit 55 and the power supply circuit are an example of the plasma display apparatus.

As each of various elements recited in the claims, various other elements having configurations or functions described in the claims can be also used.

INDUSTRIAL APPLICABILITY

The present invention is applicable to a display apparatus that displays various images.

The invention claimed is:

1. A driving device that drives a plasma display panel including a plurality of discharge cells at intersections of a plurality of scan electrodes and a plurality of sustain electrodes with a plurality of data electrodes by a sub-field method in which one field period includes a plurality of sub-fields, comprising:

a scan electrode driving circuit that drives said plurality of scan electrodes;

a sustain electrode driving circuit that drives said plurality of sustain electrodes; and a data electrode driving circuit that drives said plurality of data electrodes, wherein said scan electrode driving circuit applies a first ramp waveform rising from a first potential to a second potential to said plurality of scan electrodes in a first period within a setup period of at least one sub-field of said plurality of sub-fields, said sustain electrode driving circuit applies a driving waveform dropping from a third potential to a fourth potential to said plurality of sustain electrodes before said first period and holds said plurality of sustain electrodes at said fourth potential in said first period, and said data electrode driving circuit applies a second ramp waveform rising from a fifth potential to a sixth potential according to change of a potential of said first ramp waveform to said plurality of data electrodes in a second period that starts at a starting time point of said first period and is shorter than said first period, and holds said plurality of data electrodes at said sixth potential after said second period in said first period, said first ramp waveform is set based on said fourth potential such that discharges are generated between said plurality of scan electrodes and said plurality of sustain electrodes during change of said first ramp waveform from said first potential to said second potential, said fifth potential is set based on said fourth potential such that discharges are not generated between said plurality of sustain electrodes and said plurality of data electrodes, and said sixth potential is set based on said first ramp waveform such that discharges are generated between said plurality of scan electrodes and said plurality of data electrodes after said second period in said first period.

2. The driving device according to claim 1, wherein said data electrode driving circuit brings said plurality of data electrodes into a floating state in said second period.

3. The driving device according to claim 1, wherein said scan electrode driving circuit applies a third ramp waveform rising from a ground potential to an eighth potential to said plurality of scan electrodes at an end of a sustain period preceding the setup period of said at least one sub-field in order to decrease wall charges on the discharge cells in which sustain discharges have been performed, and said sustain electrode driving circuit holds said plurality of sustain electrodes at said fourth potential during a period of application of said third ramp waveform.

4. A driving device that drives a plasma display panel including a plurality of discharge cells at intersections of a plurality of scan electrodes and a plurality of sustain electrodes with a plurality of data electrodes by a sub-field method in which one field period includes a plurality of sub-fields, comprising:

a scan electrode driving circuit that drives said plurality of scan electrodes;

a sustain electrode driving circuit that drives said plurality of sustain electrodes; and a data electrode driving circuit that drives said plurality of data electrodes, wherein said scan electrode driving circuit applies a first ramp waveform rising from a first potential to a second potential to said plurality of scan electrodes in a first period within a setup period of at least one sub-field of said plurality of sub-fields, said sustain electrode driving circuit applies a driving waveform dropping from a third potential to a fourth potential to said plurality of sustain electrodes before said first period and holds said plurality of sustain electrodes at said fourth potential in said first period, said data electrode driving circuit applies a second ramp waveform rising from a fifth potential to a sixth potential according to change of a potential of said first ramp waveform to said plurality of data electrodes in a second period that starts at a starting time point of said first period and is shorter than said first period, said scan electrode driving circuit applies a driving waveform having a seventh potential to said plurality of scan electrodes at an end of a sustain period preceding the setup period of said at least one sub-field, and said sustain electrode driving circuit applies a driving waveform that changes from said fourth potential to said third potential to said plurality of sustain electrodes during a period of application of the driving waveform having said seventh potential in order to decrease wall charges on the discharge cells in which sustain discharges have been performed.

5. A driving method of a plasma display panel that drives the plasma display panel including a plurality of discharge cells at intersections of a plurality of scan electrodes and a plurality of sustain electrodes with a plurality of data electrodes by a sub-field method in which one field period includes a plurality of sub-fields, comprising:

applying a driving waveform dropping from a third potential to a fourth potential to said plurality of sustain electrodes before a first period within a setup period of at least one sub-field of said plurality of sub-fields;

holding said plurality of sustain electrodes at said fourth potential in said first period;

applying a first ramp waveform rising from a first potential to a second potential to said plurality of scan electrodes in said first period; and applying a second ramp waveform rising from a fifth potential to a sixth potential according to change of a potential of said first ramp waveform to said plurality of data electrodes in a second period that starts at a starting time point of said first period and is shorter than said first period, and holding said plurality of data electrodes at said sixth potential after said second period in said first period, wherein said first ramp waveform is set based on said fourth potential such that discharges are generated between said plurality of scan electrodes and said plurality of sustain electrodes during change of said first ramp waveform from said first potential to said second potential, said fifth potential is set based on said fourth potential such that discharges are not generated between said plurality of sustain electrodes and said plurality of data electrodes, and said sixth potential is set based on said first ramp waveform such that discharges are generated between said plurality of scan electrodes and said plurality of data electrodes after said second period in said first period.

6. A plasma display apparatus, comprising:

a plasma display panel including a plurality of discharge cells at intersections of a plurality of scan electrodes and a plurality of sustain electrodes with a plurality of data electrodes; and a driving device that drives said plasma display panel by a sub-field method in which one field period includes a plurality of sub-fields, wherein said driving device includes:

a scan electrode driving circuit that drives said plurality of scan electrodes, a sustain electrode driving circuit that drives said plurality of sustain electrodes, and a data electrode driving circuit that drives said plurality of data electrodes, said scan electrode driving circuit applies a first ramp waveform rising from a first potential to a second potential to said plurality of scan electrodes in a first period within a setup period of at least one sub-field of said plurality of sub-fields, said sustain electrode driving circuit applies a driving waveform dropping from a third potential to a fourth potential to said plurality of sustain electrodes before said first period and holds said plurality of sustain electrodes at said fourth potential in said first period, and said data electrode driving circuit applies a second ramp waveform rising from a fifth potential to a sixth potential according to change of a potential of said first ramp waveform to said plurality of data electrodes in a second period that starts at a starting time point of said first period and is shorter than said first period, and holds said plurality of data electrodes at said sixth potential after said second period in said first period, said first ramp waveform is set based on said fourth potential such that discharges are generated between said plurality of scan electrodes and said plurality of sustain electrodes during change of said first ramp waveform from said first potential to said second potential, said fifth potential is set based on said fourth potential such that discharges are not generated between said plurality of sustain electrodes and said plurality of data electrodes, and said sixth potential is set based on said first ramp waveform such that discharges are generated between said plurality of scan electrodes and said plurality of data electrodes after said second period in said first period.

7. A driving method of a plasma display panel that drives the plasma display panel including a plurality of discharge cells at intersections of a plurality of scan electrodes and a plurality of sustain electrodes with a plurality of data electrodes by a sub-field method in which one field period includes a plurality of sub-fields, comprising:

applying a driving waveform dropping from a third potential to a fourth potential to said plurality of sustain electrodes before a first period within a setup period of at least one sub-field of said plurality of sub-fields;

holding said plurality of sustain electrodes at said fourth potential in said first period;

applying a first ramp waveform rising from a first potential to a second potential to said plurality of scan electrodes in said first period;

applying a second ramp waveform rising from a fifth potential to a sixth potential according to change of a potential of said first ramp waveform to said plurality of data electrodes in a second period that starts at a starting time point of said first period and is shorter than said first period;

applying a driving waveform having a seventh potential to said plurality of scan electrodes at an end of a sustain period preceding the setup period of said at least one sub-field; and applying a driving waveform that changes from said fourth potential to said third potential to said plurality of sustain electrodes during a period of application of the driving waveform having said seventh potential in order to decrease wall charges on the discharge cells in which sustain discharges have been performed.

8. A plasma display apparatus, comprising:

a plasma display panel including a plurality of discharge cells at intersections of a plurality of scan electrodes and a plurality of sustain electrodes with a plurality of data electrodes; and a driving device that drives said plasma display panel by a sub-field method in which one field period includes a plurality of sub-fields, wherein said driving device includes:

a scan electrode driving circuit that drives said plurality of scan electrodes, a sustain electrode driving circuit that drives said plurality of sustain electrodes, and a data electrode driving circuit that drives said plurality of data electrodes, said scan electrode driving circuit applies a first ramp waveform rising from a first potential to a second potential to said plurality of scan electrodes in a first period within a setup period of at least one sub-field of said plurality of sub-fields, said sustain electrode driving circuit applies a driving waveform dropping from a third potential to a fourth potential to said plurality of sustain electrodes before said first period, and holds said plurality of sustain electrodes at said fourth potential in said first period, said data electrode driving circuit applies a second ramp waveform rising from a fifth potential to a sixth potential according to change of a potential of said first ramp waveform to said plurality of data electrodes in a second period that starts at a starting time point of said first period and is shorter than said first period, said scan electrode driving circuit applies a driving waveform having a seventh potential to said plurality of scan electrodes at an end of a sustain period preceding the setup period of said at least one sub-field, and said sustain electrode driving circuit applies a driving waveform that changes from said fourth potential to said third potential to said plurality of sustain electrodes during a period of application of the driving waveform having said seventh potential in order to decrease wall charges on the discharge cells in which sustain discharges have been performed.

* * * * *

UNITED STATES PATENT AND TRADEMARK OFFICE

CERTIFICATE OF CORRECTION

PATENT NO. : 8,471,785 B2
APPLICATION NO. : 12/677223
DATED : June 25, 2013
INVENTOR(S) : Takahiko Origuchi et al.

It is certified that error appears in the above-identified patent and that said Letters Patent is hereby corrected as shown below:

On Title Page 2, under item (56), References Cited, Other Publications, Column 2, line 21, the extra line "U.S. Appl. No. 12/066,552 to Shoji et al., filed Mar. 12, 2010" should be deleted.

Signed and Sealed this
Eighth Day of October, 2013

Teresa Stanek Rea
*Deputy Director of the United States Patent and Trademark Office*